US009723902B2

(12) United States Patent
Jose

(10) Patent No.: US 9,723,902 B2
(45) Date of Patent: Aug. 8, 2017

(54) COLLAPSIBLE SUITCASE, AND A METHOD FOR ITS USE

(71) Applicant: Boban Jose, San Ramon, CA (US)

(72) Inventor: Boban Jose, San Ramon, CA (US)

( * ) Notice: Subject to any disclaimer, the term of this patent is extended or adjusted under 35 U.S.C. 154(b) by 0 days.

(21) Appl. No.: 14/622,849

(22) Filed: Feb. 14, 2015

(65) Prior Publication Data

US 2016/0235172 A1 Aug. 18, 2016

(51) Int. Cl.

| | |
|---|---|
| ***A45C 7/00*** | (2006.01) |
| ***A45C 5/14*** | (2006.01) |
| ***A45C 13/26*** | (2006.01) |
| ***A45C 13/28*** | (2006.01) |
| ***A45F 3/20*** | (2006.01) |

(52) U.S. Cl.

CPC ..... *A45C 7/0036* (2013.01); *A45C 5/14* (2013.01); *A45C 13/262* (2013.01); *A45C 13/28* (2013.01); *A45F 3/20* (2013.01); *A45C 2007/0004* (2013.01); *A45C 2013/265* (2013.01)

(58) Field of Classification Search

CPC ..... A45C 7/0018; A45C 7/0036
USPC ..... 190/107; 280/37; 117/15; 217/15
See application file for complete search history.

(56) References Cited

U.S. PATENT DOCUMENTS

| | | | | |
|---|---|---|---|---|
| 853,566 | A | 5/1907 | Sparks | |
| 2,416,783 | A | 11/1944 | Vallieres | |
| 2,538,616 | A | 1/1945 | Cross | |
| 2,517,178 | A * | 8/1950 | Cheatham, Jr. | B65D 9/14 217/15 |
| 2,718,943 | A | 11/1954 | Braverman | |
| 3,606,372 | A | 9/1971 | Browning | |
| 3,814,220 | A * | 6/1974 | Brody | A45C 7/0036 190/19 |
| 4,146,045 | A | 3/1979 | Grant | |
| 4,160,496 | A | 7/1979 | Knight | |
| 4,221,402 | A | 9/1980 | Kazmark | |
| 4,538,709 | A | 9/1985 | Williams et al. | |
| 4,588,056 | A | 5/1986 | Bernbaum | |

(Continued)

FOREIGN PATENT DOCUMENTS

| | | | |
|---|---|---|---|
| DE | 202009010549 | U1 | 10/2009 |
| WO | 0152687 | A | 7/2001 |

(Continued)

OTHER PUBLICATIONS

Search Report and Written Opinion mailed May 13, 2016 from International Serial No. PCT/US2016/017464 filed Feb. 11, 2016.

(Continued)

*Primary Examiner* — Sue A Weaver
(74) *Attorney, Agent, or Firm* — Ilya Libenzon; Krista S. Jacobsen

(57) ABSTRACT

A collapsible suitcase has a bottom panel, a rear panel, two side panels, and a front panel. The rear panel, side panels, and front panel are connected to the bottom panel by hinges permitting them to be rotated from a folded position against the bottom panel to a deployed position perpendicular to the bottom panel. The side hinges have a clearance sufficiently greater than the clearance of the front hinge to allow the side hinges to lie flat on the front panel when folded, and the rear hinge has a sufficiently greater clearance than that of the side hinges to allow the rear panel to lie flat on the side panels when folded.

18 Claims, 18 Drawing Sheets

(56) References Cited

U.S. PATENT DOCUMENTS

| | | | | |
|---|---|---|---|---|
| 4,795,186 | A | 1/1989 | Tyus | |
| 5,265,307 | A * | 11/1993 | Hull | A45C 13/26 16/406 |
| 5,375,685 | A | 12/1994 | Plath | |
| 5,407,405 | A | 4/1995 | Oren | |
| 5,433,303 | A | 7/1995 | Chen | |
| 5,464,080 | A | 11/1995 | Liang | |
| 5,564,538 | A | 10/1996 | Sadow | |
| 5,699,886 | A | 12/1997 | Latshaw | |
| 5,806,143 | A | 9/1998 | Tsai | |
| 5,904,230 | A * | 5/1999 | Peterson | A45C 11/20 190/107 |
| 5,924,533 | A * | 7/1999 | Cnockaert | A45C 5/03 190/109 |
| 6,024,264 | A | 2/2000 | Java | |
| 6,105,508 | A | 8/2000 | Ryburg | |
| 6,213,265 | B1 * | 4/2001 | Wang | A45C 9/00 190/11 |
| 6,279,706 | B1 | 8/2001 | Mao | |
| 6,357,080 | B1 | 3/2002 | Tsai | |
| 6,470,533 | B1 | 10/2002 | Comstock | |
| 6,540,134 | B1 | 4/2003 | Rasche | |
| 6,543,796 | B1 | 4/2003 | Johnson et al. | |
| 6,564,426 | B1 | 5/2003 | Wang | |
| 6,776,300 | B2 * | 8/2004 | Walsh | B65D 19/18 206/386 |
| 6,898,823 | B2 | 5/2005 | Tsai | |
| 6,978,514 | B2 | 12/2005 | Kuo et al. | |
| 7,328,796 | B2 * | 2/2008 | Brunson | B25H 3/003 206/373 |
| 7,445,216 | B1 | 11/2008 | Chou | |
| 7,451,861 | B2 | 11/2008 | Bhavnani | |
| 7,617,956 | B1 | 11/2009 | Sabbah | |
| 7,832,532 | B2 | 11/2010 | Nykoluk et al. | |
| 7,845,508 | B2 * | 12/2010 | Rothschild | A45C 7/0054 190/107 |
| 7,987,955 | B2 | 8/2011 | Puchalski | |
| 8,317,558 | B2 * | 11/2012 | Bucknell | B63H 16/04 416/74 |
| 8,613,349 | B1 | 12/2013 | Halko et al. | |
| 8,662,267 | B1 | 3/2014 | Hart et al. | |
| 8,869,960 | B2 | 10/2014 | Mangano | |
| 9,277,796 | B1 | 3/2016 | Elam | |
| 2002/0056736 | A1 | 5/2002 | Conte | |
| 2002/0084159 | A1 | 7/2002 | Hamlin | |
| 2002/0096410 | A1 | 7/2002 | Nykoluk | |
| 2003/0102195 | A1 | 6/2003 | Mittleman et al. | |
| 2003/0132079 | A1 | 7/2003 | Bellini | |
| 2004/0108345 | A1 | 6/2004 | Oh | |
| 2004/0181906 | A1 | 9/2004 | Kuo et al. | |
| 2004/0238304 | A1 | 12/2004 | Fisher | |
| 2005/0011043 | A1 * | 1/2005 | Comstock | A45C 13/262 16/114.1 |
| 2005/0015932 | A1 | 1/2005 | Tsai | |
| 2005/0016809 | A1 | 1/2005 | Wu | |
| 2005/0082131 | A1 | 4/2005 | Fenton et al. | |
| 2005/0098402 | A1 | 5/2005 | Cohen | |
| 2005/0183914 | A1 | 8/2005 | Lin | |
| 2006/0037825 | A1 * | 2/2006 | Dayton | A45C 13/28 190/110 |
| 2006/0076203 | A1 | 4/2006 | Miller | |
| 2006/0118376 | A1 | 6/2006 | Godshaw et al. | |
| 2006/0272126 | A1 | 12/2006 | Burgess et al. | |
| 2007/0007801 | A1 | 1/2007 | Bishop | |
| 2007/0012593 | A1 * | 1/2007 | Kitchens | A45C 7/0036 206/545 |
| 2007/0089952 | A1 | 4/2007 | Herbst et al. | |
| 2007/0164064 | A1 | 7/2007 | Nathan | |
| 2008/0078790 | A1 | 4/2008 | Bolling | |
| 2010/0051633 | A1 | 3/2010 | Porte et al. | |
| 2010/0089778 | A1 | 4/2010 | Park | |
| 2010/0282556 | A1 | 11/2010 | Tseng et al. | |
| 2010/0313383 | A1 | 12/2010 | Lai | |
| 2011/0132708 | A1 | 6/2011 | DeLine et al. | |
| 2011/0209960 | A1 | 9/2011 | MacLean et al. | |
| 2012/0217109 | A1 | 8/2012 | King et al. | |
| 2012/0273314 | A1 | 11/2012 | Raymond et al. | |
| 2012/0325607 | A1 | 12/2012 | Webster et al. | |
| 2013/0032443 | A1 | 2/2013 | Soedomo | |
| 2013/0075213 | A1 | 3/2013 | Chi Yueh Chen et al. | |
| 2013/0075214 | A1 * | 3/2013 | Chi Yueh Chen | A45C 7/0054 190/18 A |
| 2013/0098410 | A1 | 4/2013 | Prasannakumar et al. | |
| 2013/0153351 | A1 | 6/2013 | House | |
| 2013/0175130 | A1 | 7/2013 | Liang | |
| 2013/0233362 | A1 | 9/2013 | Miller-Klerer | |
| 2013/0264160 | A1 | 10/2013 | Mediamolle | |
| 2014/0151172 | A1 | 6/2014 | Diaz | |
| 2014/0238799 | A1 | 8/2014 | Sharma | |
| 2014/0299428 | A1 | 10/2014 | Gadbois | |
| 2015/0047939 | A1 | 2/2015 | Chang | |
| 2015/0272291 | A1 | 10/2015 | Sener et al. | |
| 2015/0348347 | A1 | 12/2015 | Diz et al. | |
| 2016/0113388 | A1 | 4/2016 | Distefano | |

FOREIGN PATENT DOCUMENTS

| | | | |
|---|---|---|---|
| WO | 2009027992 | A2 | 3/2009 |
| WO | 2009039154 | A1 | 3/2009 |
| WO | 2013080236 | A1 | 6/2013 |

OTHER PUBLICATIONS

Search Report and Written Opinion mailed May 13, 2016 from International Serial No. PCT/US2016/017470 filed Feb. 11, 2016.
Search Report and Written Opinion mailed May 13, 2016 from International Serial No. PCT/US2016/017475 filed Feb. 11, 2016.
Search Report and Written Opinion mailed May 19, 2016 from International Serial No. PCT/US2016/017447 filed Feb. 11, 2016.
Search Report and Written Opinion mailed Aug. 31, 2016 from International Serial No. PCT/US2016/036485 filed Jun. 8, 2016.
Search Report and Written Opinion mailed Aug. 31, 2016 from International Serial No. PCT/US2016/036494 filed Jun. 8, 2016.

* cited by examiner

COLLAPSIBLE SUITCASE, AND A METHOD FOR ITS USE

TECHNICAL FIELD

The device and methods disclosed herein relate generally to luggage, and particularly to folding luggage.

BACKGROUND ART

Suitcases and luggage are a traveler's constant companions. Luggage can be used to transport items such as clothing, papers, electronics, gifts and memorabilia in bulk, enabling travelers to keep track of their effects more easily. Luggage generally presents the traveler with trade-offs: hard suitcases can protect fragile items, but tend to take up large amounts of space, whether empty or full. As travelers frequently do not carry the same quantity of objects on all legs of their journeys, using hard cases can frequently mean spending time and effort carrying large, empty receptacles from one place to another. Soft luggage is more compact and extensible, but provides less protection for valuable or fragile goods. Some solutions to this dilemma in the past have included gussets, which allow limited expansion of hard cases, with small corresponding loss of security, or collapsible suitcases that combine hard and soft components in an attempt to compromise between the disadvantages of the two forms. This only partially solves the issues presented by traditional luggage design.

Therefore, there remains a need for a fully collapsible hard luggage item that is durable and convenient to use.

SUMMARY OF THE EMBODIMENTS

In one aspect, a collapsible suitcase includes a rigid bottom panel having an interior surface, an exterior surface, a rear edge, a front edge, and two side edges. The collapsible suitcase includes a rigid rear panel having an interior surface, an exterior surface, a top edge, two side edges, and a bottom edge connected to the back edge of the bottom panel by at least one rear hinge allowing the rear panel to be rotated between a folded position in which the interior surface of the rear panel is substantially parallel to the interior surface of the bottom panel and a deployed position in which the interior surface of the rear panel is substantially perpendicular to the interior surface of the bottom panel. The collapsible suitcase includes two side panels, each side panel having an interior surface, an exterior surface, a top edge, a rear edge, a front edge, and a bottom edge connected to one of the two side edges of the bottom panel by at least one side hinge that permits the side panel to rotate between a folded position in which the interior surface of the side panel is substantially parallel to the interior surface of the bottom panel and a deployed position in which the interior surface of the side panel is substantially perpendicular to the interior surface of the bottom panel. The collapsible suitcase includes a front panel, the front panel having an interior surface, an exterior surface, a top edge, two side edges, and a bottom edge connected to the front edge of the bottom panel by at least one front hinge that permits the front panel to rotate between a folded position in which the interior surface of the front panel is substantially parallel to the interior surface of the bottom panel and a deployed position in which the interior surface of the front panel is substantially perpendicular to the interior surface of the bottom panel. In some embodiments, the at least one front hinge has a first clearance permitting the interior surface of the first panel to rest on the interior surface of the bottom panel when the first panel is in folded position, each of the at least one side hinges has a second clearance sufficiently larger than the first clearance to allow the interior surface of the side panels, when in folded position, to rest on top of the exterior surface of the front panel when the front panel is in folded position, and the at least one rear hinge has a third clearance sufficiently larger than the second clearance to allow the interior surface of the rear panel, when in folded position, to rest on top of the exterior surfaces of the side panels when the side panels are in folded position.

A related embodiment also includes at least one peg set perpendicularly to the interior surface of the bottom panel where the bottom edge of the rear panel, side panel, or front panel contacts the interior surface of the bottom panel when deployed and at least one hole in the bottom edge of the back panel, side panel, or front panel, the at least one hole positioned to pass over the at least one peg when the rear panel, side panel, or front panel is rotated into deployed position. In another related embodiment, each side edge of the rear panel further includes at least one first engagement member, and the rear edge of each side panel has a second engagement member that slidably engages the at least one first engagement member, fixing the side panel to the rear panel, when the rear panel is already in deployed position and the side panel is rotated into deployed position. In an additional embodiment, the front edge of at least one of the side panels has a third engagement member, and the corresponding at least one side edge of the front panel has a fourth engagement member that slidably engages the first engagement member, fixing the front panel to the at least one side panel, when the at least one side panel is already in deployed position and the front panel is rotated into deployed position. Another embodiment also includes at least one latch that secures the front edge of at least one of the side panels to the front panel when the at least one side panel is in deployed position and the front panel is rotated into deployed position.

An additional embodiment also includes an exterior covering, the exterior covering including a first portion fixed to the exterior surface of each side panel and connecting the front edges of the two side panels to each other, so that the exterior surface of the front panel rests against the first portion when the front panel is in deployed position, the first portion having a first perimeter edge against the bottom edge of each side panel and against the front edge of the bottom panel and a second perimeter edge against the rear edge of each side panel, the top edge of each side panel, and the top edge of the front panel when the front panel is in deployed position and a second portion fixed to the exterior surface of the bottom panel and fixed to the exterior surface of the rear panel, and having a first perimeter edge fixed to the first perimeter edge of the first portion, a second perimeter edge against one side edge of the rear panel, and a third perimeter edge against the other side edge of the rear panel. In a related embodiment, the second portion further includes a lid that may be folded to a closed position covering an opening in the suitcase bordered by the top edge of the rear panel, the top edge of each side panel and the top edge of the front panel, when the rear panel, the side panels, and the front panel are in deployed position. Another embodiment also includes a zipper having a first half that covers the second perimeter of the first portion and a second half covering the second perimeter edge of the second portion, a portion of the lid that contacts the second perimeter of the first portion when the lid is in the closed position, and the third perimeter edge of the second portion. In another embodiment, the lid further includes at least one rigid panel. In still another embodiment, the lid is flexible, so that the lid may be wrapped around the suitcase when the front panel, side panels, and rear panels are in folded position. In a further embodiment, the lid also includes at least one first rigid panel and at least one second rigid panel separated by a flexible portion. In another embodiment, each of the distance from the top edge of the rear panel to the to the interior surface of the bottom panel and the distance from the top edge of the front panel to the interior surface of the bottom panel is less than the distance from the top edge of each side panel to the interior surface of the bottom panel, and the lid includes a central panel that has a front edge and a rear edge, occupying a position at the height of the top edges of the two side panels and substantially parallel to the interior surface of the bottom panel when the lid is in its closed position, a forward panel flexibly joined to the front edge of the central panel, the forward panel slanting down from the front edge of the central panel to the top edge of the front panel when the lid is in the closed position, and a back panel flexibly joined to the rear edge of the central panel, the back panel slanting down from the rear edge of the central panel to the top edge of the rear panel when the lid is in the closed position. Yet a further embodiment also includes at least one fastener that fastens the lid to the second portion at the exterior surface of the bottom panel of the suitcase when the lid is wrapped around the suitcase. In a further embodiment still, the lid also includes at least one projection that rests against at least one of the interior surface of the rear panel, the interior surface of at least one side panel, and the interior surface of the front panel when the lid is in the closed position.

Another related embodiment also includes an extensible handle system that includes a chamber in the bottom panel, the chamber having a first end, a second, a front side, and aback side parallel to the front side, the chamber having an opening at the first end, two handle rods inserted within in the chamber along the front side and the back side of the chamber, the two handle rods free to slide out of the opening into an extended position, each handle rod having a first end that extends out of the chamber when the two handle rods are in the extended position and a second end that remains within the chamber when the two handle rods are in the in the extended position, at least one engagement latch that fixes the two handle rods relative to the chamber when the two handle rods are in the extended position, and a handle, connected to the first end of each handle rod.

In a further embodiment the extensible handle system also includes two interior rods inserted in the chamber along the front and back sides of the chamber, wherein each handle rod contains a slot that slidably admits one of the two interior rods, and wherein the engagement latches fix the two handle rods to the two interior rods. In an additional embodiment, the handle is connected to the two handle rods by a swivel that allows the handle to rotate freely about a first axis. In a further embodiment, the handle is substantially toroidal, the handle contains a track describing a substantial circle on the handle, and the swivel is slidably attached to the track, permitting the handle to be rotated about a second axis. In further embodiment still, the extensible handle system also includes at least one pocket fixed between the two handle rods, the at least one pocket capable of sliding into and out of the chamber with the two handle rods. In another embodiment, the at least one pocket contains a fold-out tray, the tray comprising at least one rigid panel having a distal end and a proximal end, and a hinge slidably attached within the pocket and attached to the proximal end of the at least one panel, the hinge permitting the tray to be rotated between a position substantially parallel to the two handle rods and a position substantially perpendicular to the two handle rods. In another embodiment, the tray further includes at least one leaf joined to the at least one panel by at least one hinge that permits the at least one leaf to rotate between a folded position resting on the at least one panel and a deployed position adjacent and parallel to the at least one panel. In an additional embodiment, the tray also includes a lip at the distal end of the at least one panel.

In another aspect a method for collapsing a collapsible suitcase includes providing a collapsible suitcase as described above. The method includes rotating the front panel into folded position. The method includes rotating each side panel into folded position. The method includes rotating the rear panel into folded position.

Other aspects, embodiments and features of the disclosed device and method will become apparent from the following detailed description of the invention when considered in conjunction with the accompanying figures. The accompanying figures are for schematic purposes and are not intended to be drawn to scale. In the figures, each identical or substantially similar component that is illustrated in various figures is represented by a single numeral or notation at its initial drawing depiction. For purposes of clarity, not every component is labeled in every figure. Nor is every component of each embodiment of the device and method is shown where illustration is not necessary to allow those of ordinary skill in the art to understand the device and method.

BRIEF DESCRIPTION OF THE DRAWINGS

The preceding summary, as well as the following detailed description of the disclosed device and method, will be better understood when read in conjunction with the attached drawings. It should be understood that the invention is not limited to the precise arrangements and instrumentalities shown.

DETAILED DESCRIPTION OF SPECIFIC EMBODIMENTS

Figure 1A:
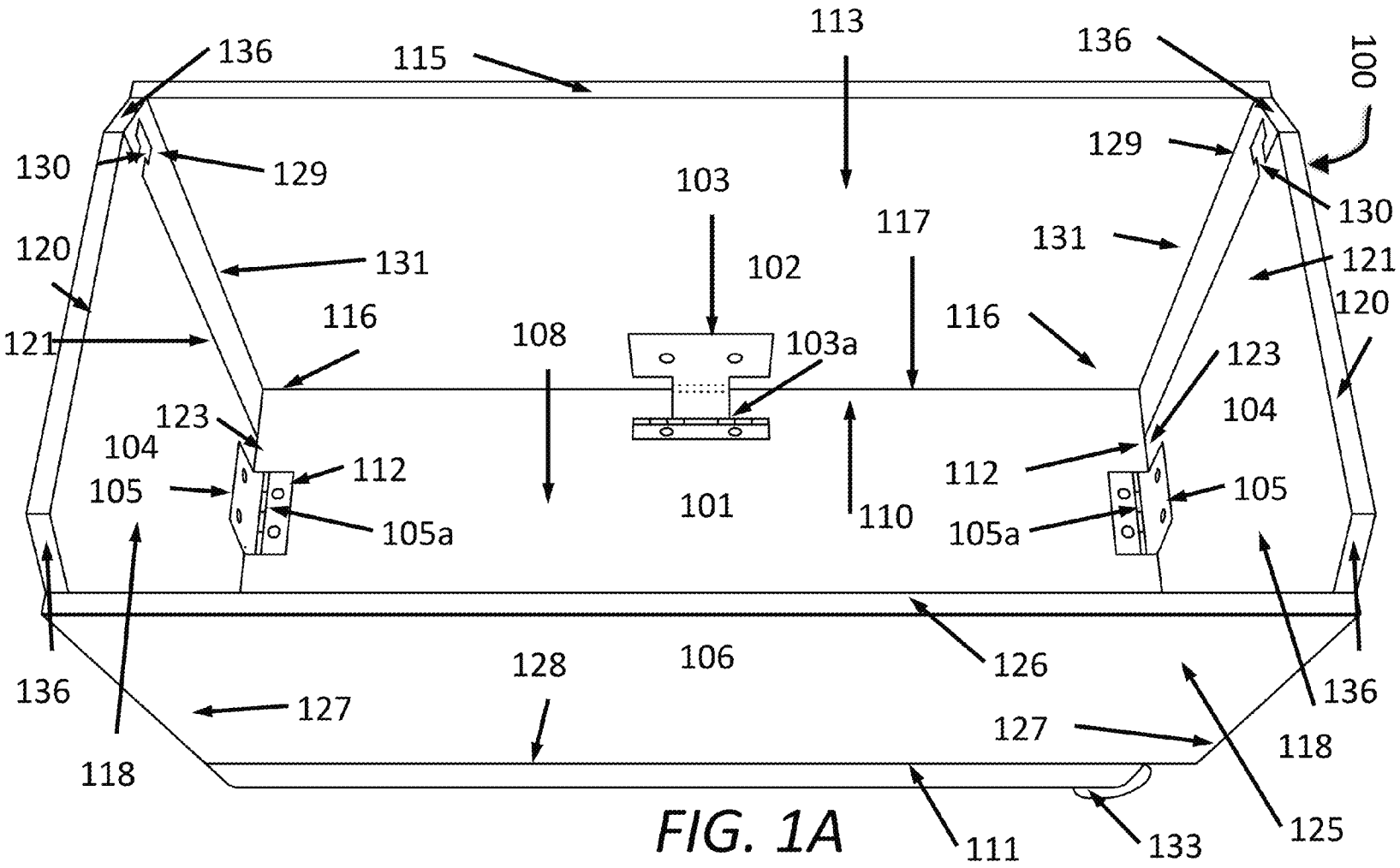
FIG. 1A is a schematic diagram illustrating one embodiment of a collapsible suitcase.

Embodiments of the disclosed suitcase provide travelers with an easily foldable suitcase that is compact when collapsed and rigid and protective when deployed. In some embodiments, the collapsed form of the disclosed suitcase may easily be carried as a satchel, stowed in other luggage items, or stored in a closet for future use. Some embodiments also include a uniquely ergonomic handle for pulling wheeled embodiments, as well as additional pockets for storage and trays to support electronic devices and books for work or entertainment.

FIGS. 1A-1E depict some embodiments of a collapsible suitcase 100. FIGS. 2A-2F illustrate the steps involved in collapsing some embodiments of the suitcase 100; in some embodiments, unfolding or deploying the suitcase involves reversing the steps illustrated in FIGS. 2A-2F. As an overview, some embodiments of the collapsible suitcase 100 include a rigid bottom panel 101, a rigid rear panel 102 connected to the bottom panel 101 by means of at least one rear hinge 103, two side panels 104 each connected to the bottom panel by means of at least one side hinge 105, and one front panel 106 connected to the bottom panel 101 by means of at least one front hinge 107.

Figure 1B:
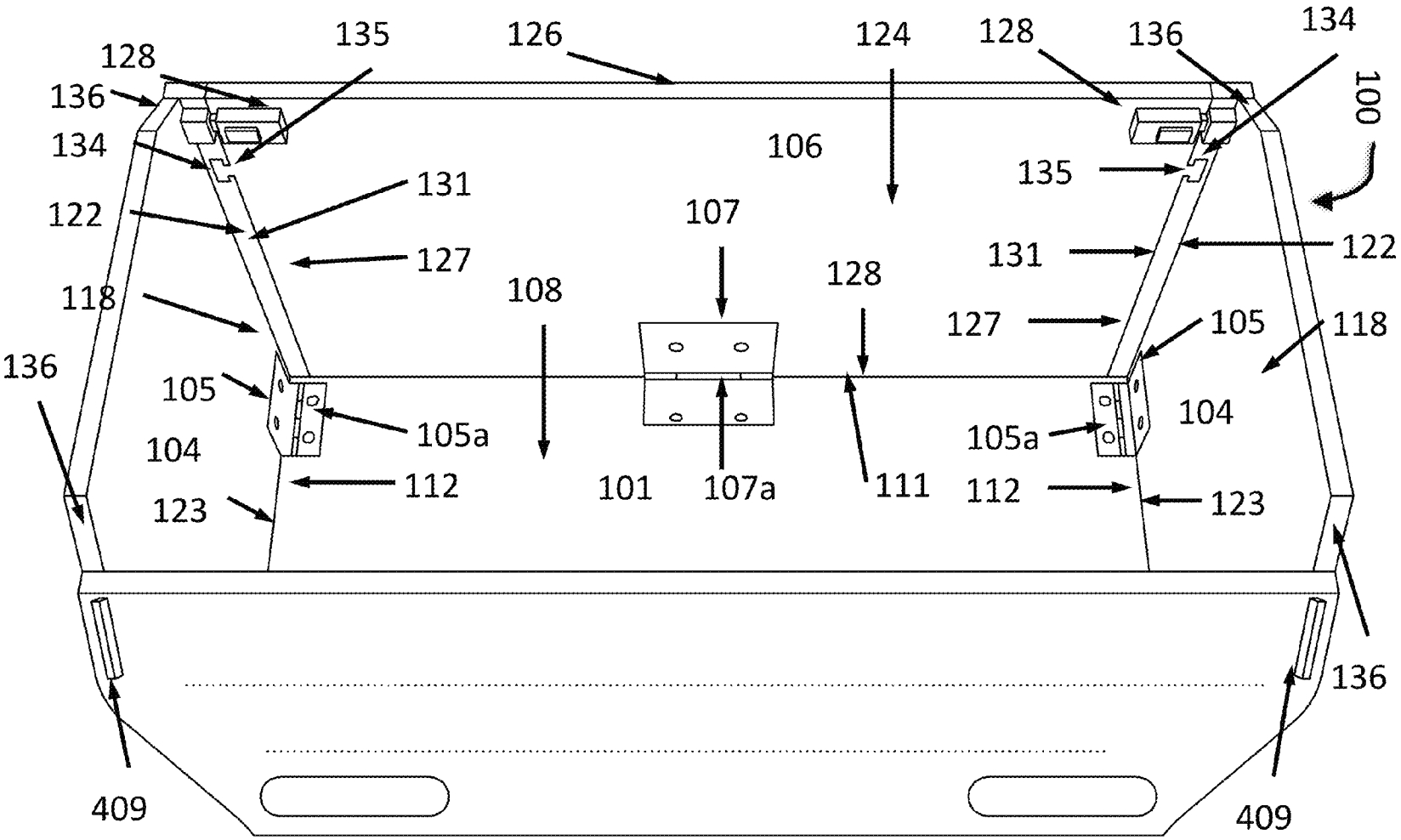
FIG. 1B is a schematic diagram illustrating one embodiment of a collapsible suitcase.
Figure 1C:
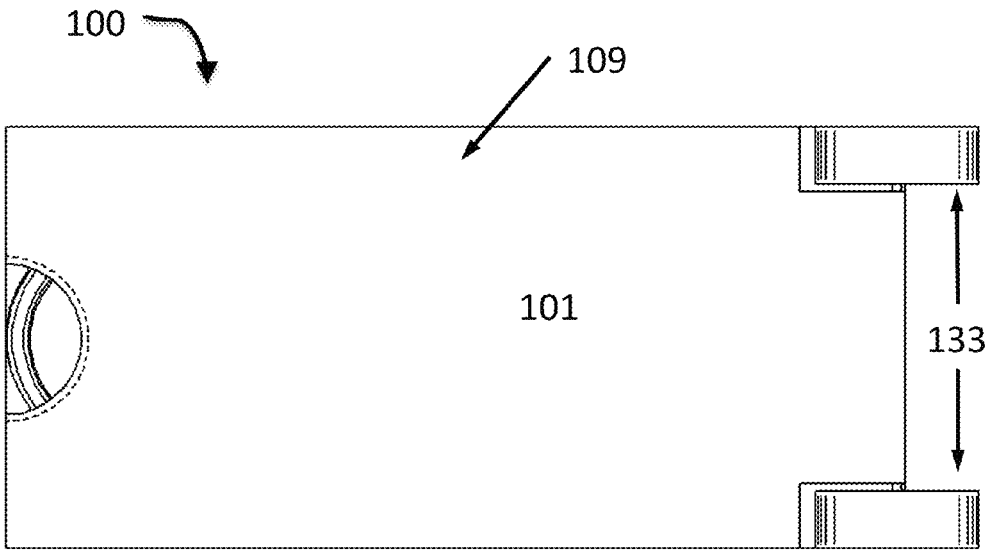
FIG. 1C is a schematic diagram illustrating one embodiment of a collapsible suitcase.
Figure 1D:
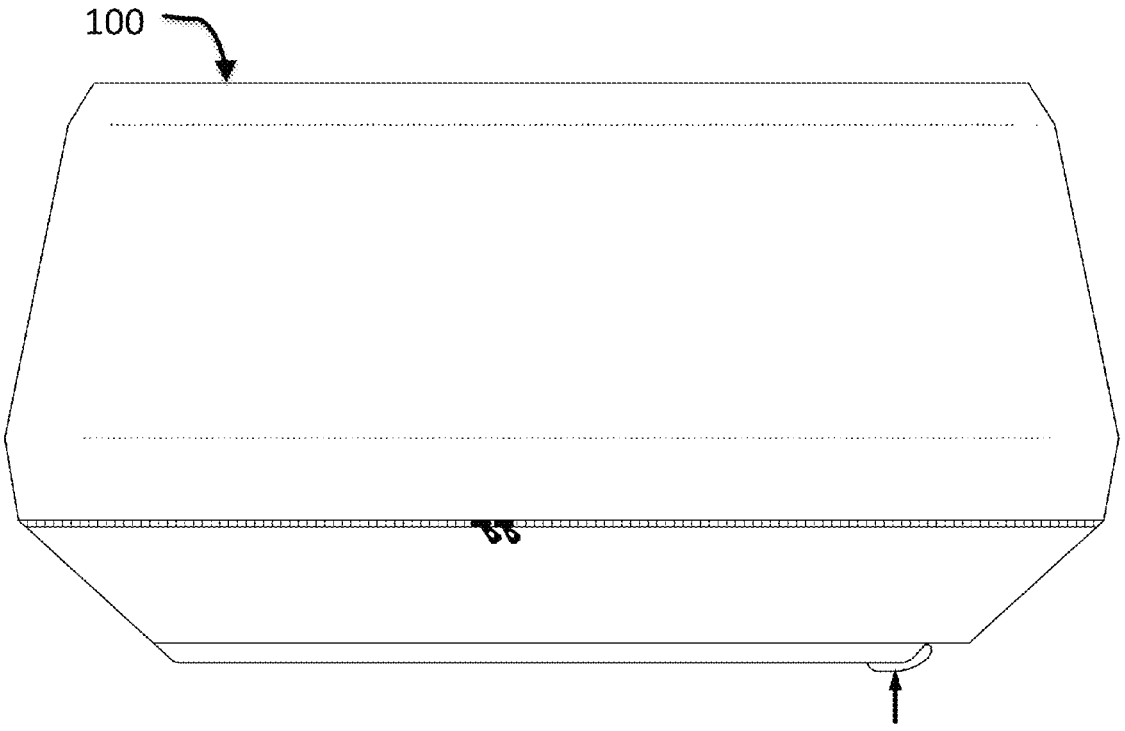
FIG. 1D is a schematic diagram illustrating one embodiment of a collapsible suitcase.
Figure 1E:
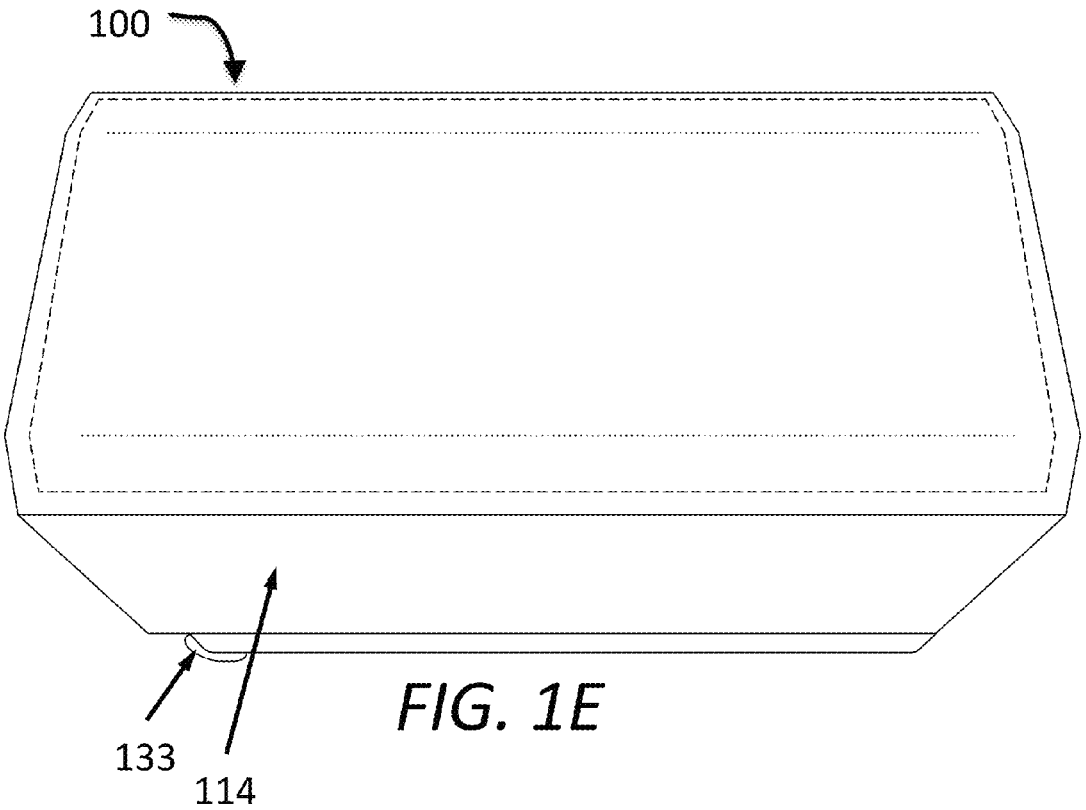
FIG. 1E is a schematic diagram illustrating one embodiment of a collapsible suitcase.

Viewing FIGS. 1A and 1B in further detail, in some embodiments the bottom panel 101 has an interior surface 108, and an exterior surface 109. The bottom panel 101 may be any shape conducive to its use as described herein. The bottom panel 101 may be substantially polygonal; for instance, the bottom panel 101 may be substantially square. The bottom panel 101 may be a substantially regular polygon. The bottom panel 101 may be substantially an irregular polygon; for instance, the bottom panel 101 may be rectangular. The bottom panel 101 may be trapezoidal. The bottom panel 101 may be substantially a combination of polygons. As an example bottom panel 101 may be describable in as a combination of variously sized and formed triangles. The bottom panel 101 may be curved. The bottom panel 101 may be elliptical. The bottom panel 101 may be circular. The bottom panel 101 may be a more complex curved form, such as a bent or irregular ellipse. The bottom panel 101 may be any combination of curved and polygonal forms; for instance, the bottom panel 101 may be rectangular with rounded corners. The bottom panel 101 may be a parabola truncated by at least one straight line. The bottom panel 101 may have indentations in its perimeter. The bottom panel 101 may have protrusions from its perimeter. In some embodiments, the bottom panel 101 is substantially quadrilateral; the bottom panel 101 may, for instance, be a rectangle, trapezoid, or parallelogram with sharp, squared, or rounded corners. In some embodiments, the bottom panel 101 has a rear edge 110. The bottom panel 101 may have a front edge 111. The bottom panel 101 may have two side edges 112. In some embodiments, the bottom panel has additional edges.

The bottom panel may be constructed of any material or combination of materials that make the bottom panel rigid. In some embodiments, the bottom panel 101 is rigid if the bottom panel 101 exhibits only small amounts of displacement relative to the size of the bottom panel 101 when forces typical for the operation of a suitcase act against the interior 108 or exterior 109 surface of the bottom panel 101. For instance, if the suitcase 100 is in its deployed form, as set forth in further detail below, and a person leans on the middle of the exterior surface 109 for support, the person may feel the bottom panel 101 flex only slightly; in some embodiments, the person may be incapable of detecting any displacement of the bottom panel at all. The bottom panel 101 may be constructed of materials including wood. The bottom panel 101 may be constructed of materials including plywood. The bottom panel 101 may be constructed of materials including metal. The bottom panel 101 may be constructed of materials including hard plastic, such as thermosetting plastics, hard thermoplastics such as polyvinyl chloride (PVC), high-density polyethylene (HDPE), polytetraflouroethylene, or hard polypropylene. The bottom panel 101 may be constructed of materials including natural polymers. The bottom panel 101 may include one or more layers of flexible material around the rigid material. The flexible material may include cloth, rubber, or other flexible polymers; the flexible material may be any material suitable for the construction of the exterior cover 400 as described in further detail below. The bottom panel 101 may be composed wholly or in part of flexible material stretched over a rigid frame or mesh. The bottom panel 101 may be composed wholly or partially of fiberglass.

The rear panel 102 may be constructed of any materials or combination of materials suitable for the construction of the bottom panel 101. The rear panel 102 may be any shape suitable for the shape of the bottom panel 101. In some embodiments, the rear panel 102 has an interior surface 113, an exterior surface 114, a top edge 115, two side edges 116, and a bottom edge 117. The at least one rear hinge 103 may allow the rear panel 102 to be rotated between a folded position in which the interior surface 113 of the rear panel is substantially parallel to the interior surface 108 of the bottom panel 101, as shown below in FIG. 2E, and a deployed position in which the interior surface 113 of the rear panel 102 is substantially perpendicular to the interior surface 108 of the bottom panel 101.

The two side panels 104 may be constructed of any materials or combination of materials suitable for the construction of the bottom panel 101. Each side panel 104 may be any shape suitable for the shape of the bottom panel 101. In some embodiments, each side panel 104 has an interior surface 118, an exterior surface 119, a top edge 120, a rear edge 121, a front edge 122, and a bottom edge 123. The at least one side hinge 105 may allow each side panel 104 to be rotated between a folded position in which the interior surface 118 of the side panel 104 is substantially parallel to the interior surface 108 of the bottom panel 101, as shown below in FIGS. 2C-2D, and a deployed position in which the interior surface 118 of the side panel 104 is substantially perpendicular to the interior surface 108 of the bottom panel 101.

The front panel 106 may be constructed of any materials or combination of materials suitable for the construction of the bottom panel 101. The front panel 106 may be any shape suitable for the shape of the bottom panel 101. In some embodiments, the front panel 106 has an interior surface 124, an exterior surface 125, a top edge 126, two side edges 127, and a bottom edge 128. The at least one front hinge 107 may allow the front panel 106 to be rotated between a folded position in which the interior surface 124 of the front panel 106 is substantially parallel to the interior surface 108 of the bottom panel 101, as shown below in FIG. 2B, and a deployed position in which the interior surface 124 of the front panel 106 is substantially perpendicular to the interior surface 108 of the bottom panel 101.

Figure 2A:
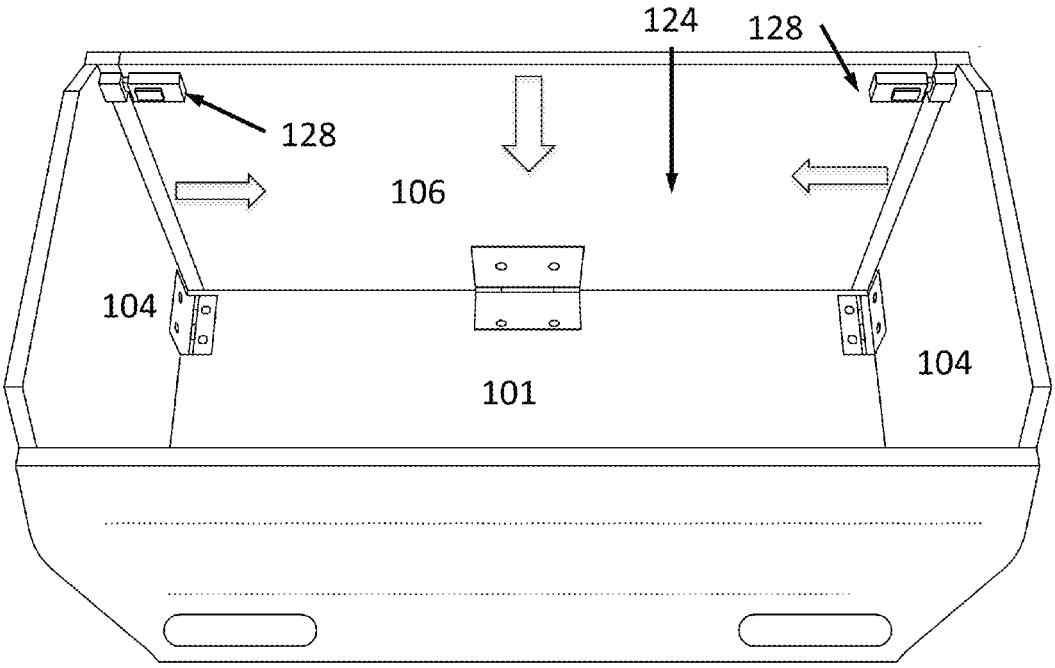
FIG. 2A is a schematic diagram illustrating step in collapsing an embodiment of a collapsible suitcase.

In one embodiment, the suitcase 100 includes at least one latch 128 that secures the front edge 122 of at least one of the side panels 104 to the front panel 106 when the at least one side panel 104 is in deployed position and the front panel 106 is rotated into deployed position. The at least one latch 128 may be constructed of any material or combination of materials suitable for the construction of the bottom panel 101. The at least one latch 128 may have one component attached to one or both side edges 127 of the front panel, and a second component attached to one or both front edges 122 of the side panel 104. The at least one latch 128 may be formed to engage automatically when the front panel 106 is rotated into deployed position between the deployed side panels. As a non-limiting example, the at least one latch 128 may have a spring-biased bolt with an angled end that causes the bolt to retract slightly when an object presses against the bolt in a direction substantially orthogonal to the direction in which the bolt moves, and to be urged back into an extended position in the absence of external pressure, as in a tubular latch for a door. Persons skilled in the art will be aware of many other latches designed to engage automatically. The at least one latch 128 may have a component that enables the user to engage or disengage the at least one latch 128 manually; for instance, the at least one latch 128 may engage automatically when the front panel 106 is swung into deployed position between the two side panels, and remain engaged until a user disengages the at least one latch 128 manually; for instance, as shown in FIG. 2A, the user may disengage each latch 128 prior to folding down the front panel 106 to commence collapsing the suitcase 100. In some embodiments, at least one additional latch (not shown) secures one or both side panels 104 to the rear panel 102 when the rear panel 102 is in deployed position and the one or more side panels 104 are rotated into deployed position.

In some embodiments of the suitcase, 100, at least one side edge of the rear panel includes at least one first engagement member 129, and the rear edge of at least one side panel has a second engagement member 130 that slidably engages the first engagement member 129, fixing the side panel 104 to the rear panel 102, when the rear panel 102 is already in deployed position and the side panel 104 is rotated into deployed position. As an example, one or both of the side edges 116 of the rear panel 102 have one or more protrusions 131 in a direction substantially perpendicular to the interior surface 113 of the rear panel 102; the one or more protrusions 131 may extend from the top edge 115 to the bottom edge 117 of the rear panel 102. Continuing the example, the one or more protrusions 131 may have at least one indentation or slot 129 positioned to engage a corresponding member 130 slidably. Further continuing the example, the rear edge 121 of at least one side panel may have at least one protrusion or tab 130 that slide into the at least one indentation or slot 129 in the at least one protrusion 131 when the rear panel 102 and each side panel 104 are in their unfolded positions. The mutually engaging members may secure the side panels 104 to the rear panel 102; the side panels 104 may be further secured in the deployed position by the at least one latch 128 securing the side panels 104 to the front panel 106, causing the suitcase 100 to present a solid and rigid body when fully deployed. For instance, the front panel 106 may prevent the side panels 104 from rotating out of their deployed positions when the front panel 106 is in its deployed position, causing the engagement members 129, 130 to secure the rear panel in its deployed position, and lending rigidity to the connection between the rear panel 102 and the side panels 104

Figure 2B:
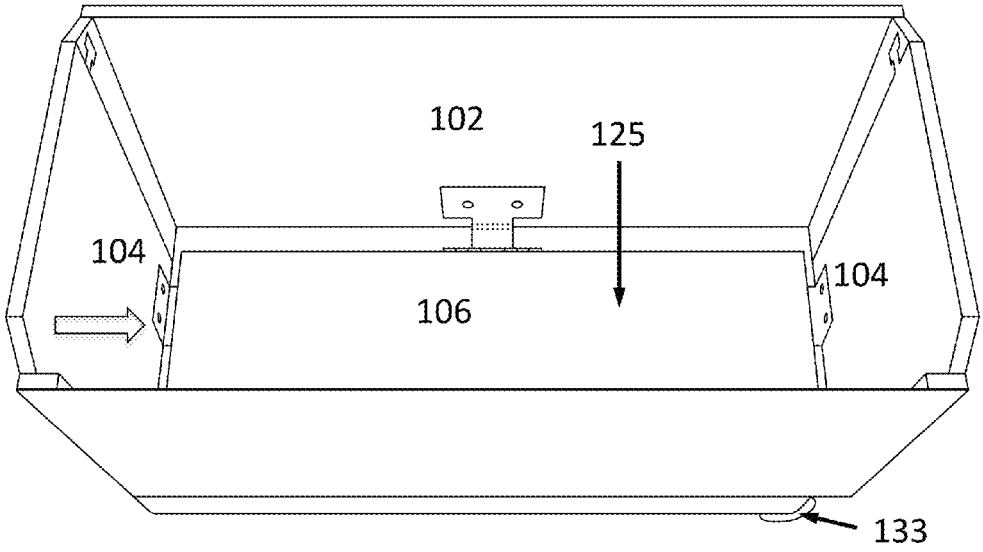
FIG. 2B is a schematic diagram illustrating step in collapsing an embodiment of a collapsible suitcase.
Figure 2C:
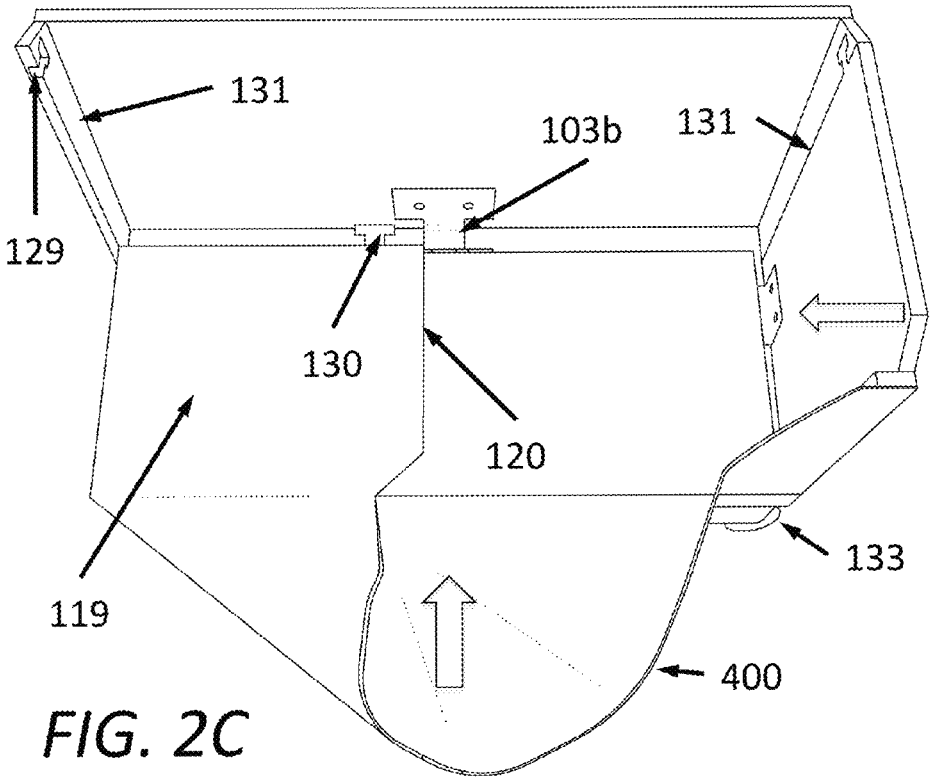
FIG. 2C is a schematic diagram illustrating step in collapsing an embodiment of a collapsible suitcase.
Figure 2D:
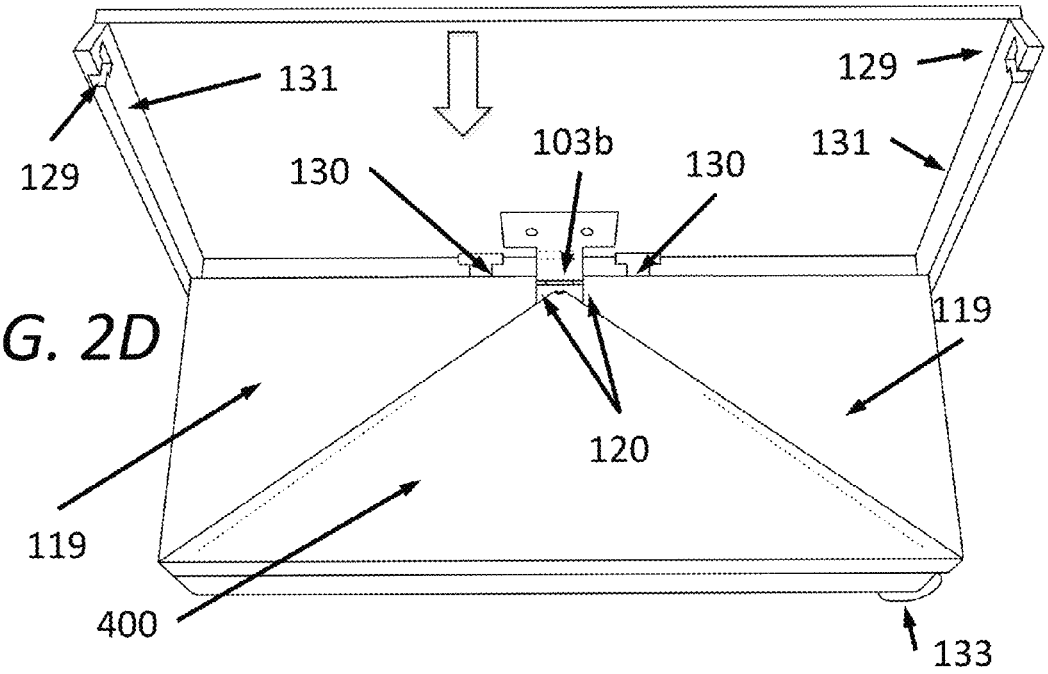
FIG. 2D is a schematic diagram illustrating step in collapsing an embodiment of a collapsible suitcase.

The hinges 103, 105, 107 may be constructed of any material or combination of materials suitable for the construction of the bottom panel 101. The hinges 103, 105, 107 may have progressively larger clearances so that when the panels are folded in a certain order, each panel can rest on top of the previously folded panels in its folded position, substantially parallel to the top surface 108 of the bottom panel 101. For instance, in some embodiments, the at least one front hinge 107 has a first clearance permitting the interior surface 124 of the front panel 106 to rest on the interior surface 108 of the bottom panel 101 when the front panel 106 is in folded position, as shown in FIG. 2B; for instance, the at least one front hinge 107 may have a pivot point 107*a* at or very close to the juncture of the bottom edge 128 of the front panel 106 and the front edge 111 of the bottom panel 101. The at least one side hinge 105 of each side panel 104 may have a larger clearance to fit the side panel 104 over the front panel 106 when the front panel 106 is in its folded position; for instance, each of the at least one side hinges 105 may have a second clearance sufficiently larger than the first clearance to allow the interior surface 118 of the side panels 104, when in folded position, to rest on top of the exterior surface 125 of the front panel 106 when the front panel 106 is in folded position. As an example, the pivot 105*a* of the least one side hinge 105*a* may be offset from the junction of the bottom edge 123 of each side panel 104 and the corresponding side edge 112 of the bottom panel 101; the offset may be substantially the same as the thickness of the front panel 106. In some embodiments, the two side panels overlap each other in folded position; in that case, one of the two side panels may have a hinge with a third clearance (not shown) permitting the interior surface 118 of that side panel 104, when in folded position, to rest on top of the exterior surface 119 of the other side panel 104 when the other side panel 104 is in folded position. For instance, the offset of the hinge of one side panel 104 may be greater than the offset of the hinge of the other side panel The at least one rear hinge 103 may have a larger clearance than that of the at side hinges 105 to fit the rear panel over the folded side panels 104 when the rear panel 102 is moved into its folded position; for example, in some embodiments, the at least one rear hinge 103 has a third clearance sufficiently larger than the second clearance to allow the interior surface 113 of the rear panel 102, when in folded position, to rest on top of the exterior surfaces 119 of the side panels 104 when the side panels 104 are in folded position. The at least one rear hinge 103 may have a pivot point 103*a* that is further offset from the juncture of the bottom edge 117 of the rear panel 101 and the rear edge 110 of the bottom panel 101 than the offset of the side hinges 105. The offset may be substantially the same as the combined thickness of the front and side panels when folded together, or slightly larger to accommodate folds of the exterior covering 400, described in further detail below. The offset of the rear hinge 103 may be greater if the side panels 104 overlap each other when folded, as described above. In some embodiments, as shown in FIGS. 2C-D, the top edges 120 of two side panels do not meet in the middle of the suitcase 100 when the two side panels 104 are in folded position, resulting in a gap between the two side panels' top edges 120; the rear hinge 103 may have a narrow central portion 103*b* to allow the rear hinge to pass between the top edges 120 of two side panels.

In some embodiments, at least one side panel 104 has at least one projection 132 at the front edges 122. The at least one projection 132 may be substantially orthogonal to the plane of the interior surface 118 of the at least one side panel 104. In some embodiments, the at least one projection 132 allows the side edges 127 of the front panel 106 to fit snugly against the at least one projection 132 while being slightly inset from the side edges 112 of the bottom panel 101, allowing greater freedom of movement for the at least one hinge 105 of the side panels 104 when the side panels 104 rotate into folded position. Likewise, the at least one projection 131 of rear panel 102 may enable the rear edges 122 of the side panels 104 to be slightly inset from the rear edge 111 of the bottom panel 102, allowing the bottom panel 102 to swing over the side panels 104 when being rotated into folded position. The top edge 126 of the front panel 106 may line up with the rear edges 122 of the side panels 104 when the front panel 106 is in folded position. The corners of the suitcase formed by the panels 101, 102, 104, 106 may be sharp or rounded, depending on the shapes of the panels, engagement members, and extensions. In some embodiments, the front edge 122 at least one of the side panels 104 has a third engagement member 134, and the corresponding at least one side edge 127 of the front panel 106 has a fourth engagement member 135 that slidably engages the first engagement member 134, fixing the front panel 106 to the at least one side panel 104, when the at least one side panel 104 is already in deployed position and the front panel 106 is rotated into deployed position. This may be implemented as described above for the first 129 and second 130 engagement members in reference to FIG. 1A.

Figure 3:
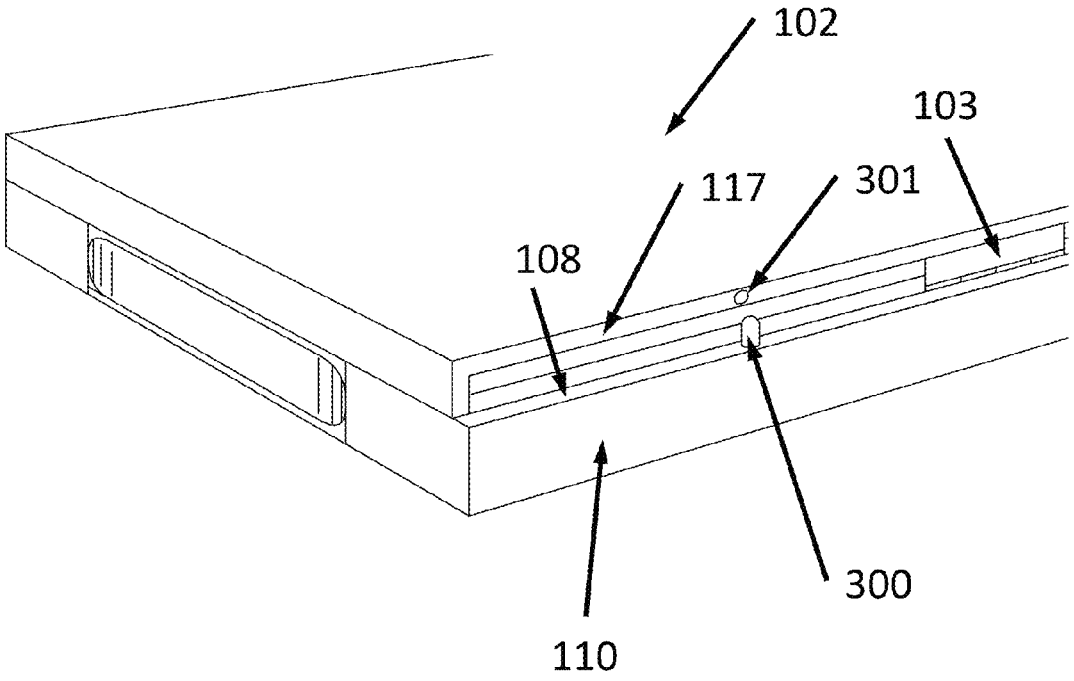
FIG. 3 is a schematic diagram illustrating one embodiment of a supplemental support mechanism used in a collapsible suitcase.

In some embodiments, as shown in FIG. 3, the suitcase 100 includes one or more additional structural elements to increase the strength of the suitcase 100 when deployed. For example, the bottom panel 101 may have at least one peg 300 set perpendicularly to the interior surface 108 of the bottom panel 101 where the bottom edge of the back panel 102, side panel 104, or front panel 106 contacts the interior surface 108 of the bottom panel 101 when deployed, for insertion in a corresponding hole in the bottom edges; for instance, as shown in FIG. 3, the at least one peg 300 may be located on the portion of the interior surface 108 of the bottom panel 101 where the bottom edge 117 of the rear panel 102 contacts the interior surface 108 when the rear panel 102 is deployed. Some embodiments include at least one hole 301 in the bottom edge of the back panel, side panel, or front panel, the at least one hole positioned to pass over the at least one peg when the rear panel, side panel, or front panel is rotated into deployed position. Continuing the example, the bottom edge 117 of the rear panel 102 may have at least one hole 301 positioned to pass over the at least one peg 300 when the rear panel 102 is rotated into deployed position.

In some embodiments, the suitcase 100 has one or more wheels 133. In some embodiments, the suitcase 100 has a first wheel 133 at the corner formed by the rear edge 110 of the bottom panel 101 and a side edge 112 of the bottom panel 101, and a second wheel 133 at the corner formed by the same side edge 112 of the bottom panel 101 and the front edge 111 of the bottom panel 101. In other embodiments, the suitcase has four or more wheels. The wheels 133 may be oriented in a fixed direction relative to the suitcase 100. The wheels 133 may be mounted on pivots; for instance, the suitcase 100 may have four wheels attached to the corners of the bottom panel 101, a side panel 104, the front panel 106 or the rear panel 102. The one more or wheels 133 may be constructed of any material or combination of materials suitable for the construction of the bottom panel 101.

In some embodiments, the suitcase 100 has an exterior covering 400. In some embodiments, the exterior cover 400 is flexible. The exterior cover 400 may be constructed entirely of flexible materials. The exterior cover may 400 may include one or more rigid portions; for instance, the exterior cover 400 may include one or more rigid panels (not shown) joined to one another. The rigid panels may be joined by flexible sections; for instance, the rigid panels may be joined by strips or sections of flexible material (not shown); the rigid panels may be contained in pockets in a flexible material covering the entire external covering 400. The rigid panels may be constructed of any material or combination of materials suitable for the construction of the bottom panel 101. In some embodiments, the exterior cover 400 is made wholly or in part of flexible material. The flexible material may be textile material; the textile material may include natural fibers. The natural fibers may include plant material, such as cotton, linen, hemp, or manila hemp; for example, the flexible material may be a woven product such as canvas. The natural fibers may include animal fibers such as wool or silk. The flexible material may include synthetic fibers, including fibers made from synthetic polymers, such as nylon and polypropylene. The flexible material may include fibers made from natural materials, such as rayon. The flexible material may include leather. The flexible material may include one or more sheets of natural polymers, such as rubber. The flexible material may include one or more sheets of synthetic polymers, such as flexible plastics.

In some embodiments, the flexible material is flexible along one axis, but not along another. For instance, the flexible material may include many closely-placed thin but long rigid substantially parallel strips or rods stuck to a flexible material, with sufficient space between the strips or rods to allow the material to flex along an axis substantially parallel to the strips; the strips or rods may prevent the flexible material from bending along any axis having a substantial component orthogonal to the direction of the strips or rods. The strips or rods may be rigid as defined above in for the bottom panel 101 in reference to FIGS. 1A-2F.

The exterior covering may include a first portion 400*a* fixed to the exterior surface 119 of each side panel 106 and connecting the front edges 122 of the two side panels to each other, so that the exterior surface 125 of the front panel 106 rests against the first portion 400*a* when the front panel 106 is in deployed position; in other words, the first portion 400*a* of the exterior covering 400 may wrap around the front and sides of the suitcase 100. In one embodiment, the exterior cover 400 or any portions thereof may be fixed to the exterior surface of a panel if the exterior cover 400 covers substantially all of the exterior surface of the panel both when the panel is folded and deployed; the exterior cover may be adhered or fastened to the exterior surface of the panel. The exterior cover may have a pocket or sleeve containing the panel; the panel may be sewn between layers of the exterior cover 400. The first portion 400*a* may have a first perimeter edge 401 against the bottom edge 123 of both of the side panels 104 and against the front edge 111 of the bottom panel 101 and a second perimeter edge 402 against the rear edge 121 of each side panel 104, the top edge 120 of each side panel, and the top edge 126 of the front panel 106 when the front panel 106 is in deployed position. The exterior covering 400 may include a second portion 400*b* fixed to the exterior surface 109 of the bottom panel 109 and fixed to the exterior surface 114 of the rear panel 102. In some embodiments, the second portion 400*b* may have a first perimeter edge 403 fixed to the first perimeter edge 401 of the first portion 400*a*, a second perimeter edge 404 against one side edge 116 of the rear panel 102, and a third perimeter edge 405 against the other side edge 116 of the rear panel 102. The first portion 400*a* and second portion 400*b* may or may not represent the physical sections assembled to create the exterior covering 400 in practice. In some embodiments, the first portion 400*a* and second portion 400*b* are made separately and fixed together, for instance by sewing the first perimeter edge 401 of the first portion 400*a* to the first perimeter edge 403 of the second portion 400*b*. In other embodiments, the exterior covering 400 is made of more sections attached together by sewing or other means; the divisions between sections may not correspond to divisions between the second portion 400*b* and the first portion 400*a*. In some embodiments, the exterior covering is constructed as a monolithic whole; for instance, the exterior covering 400 may be made as a cross-shaped sheet with its center sized to cover the exterior surface 109 of the bottom panel, and arms sized to cover the side panels 104, rear panel 102, and front panel 106, to be sewn or otherwise attached together at the corner of the front panel 106 with the side panels 104. Persons skilled in the art will be aware of other methods of construction and design that may be substituted for those described here to create the exterior covering 400 as described herein. In some embodiments, where the exterior covering 400 is flexible around only one set of parallel axes, the axes are arranged in the first portion 400*a* in a direction running from the bottom edge to the top edge of each side panel and the front panel. In some embodiments, the exterior covering 400 near to a hinge is flexible along an axis parallel to the axis of rotation of that hinge.

In some embodiments, the second portion 400*b* includes a lid 406 that may be folded to a closed position covering an opening in the suitcase 100 bordered by the top edge 115 of the rear panel 102, the top edge 120 of each side panel 104 and the top edge 126 of the front panel 106, when the rear panel 102, the side panels 104, and the front panel 106 are in deployed position. The lid 406 may have any shape sufficient to cover the opening. The lid 406 may be secured to the opening by a zipper 407. The zipper 407 may have a first half 407*a* that covers the second perimeter 402 of the first portion 400*a* and a second half 407*b* covering the second perimeter edge 404 of the second portion 400*b*, a portion of the lid 406 that contacts the second perimeter 403 of the first portion 400*a* when the lid 406 is in the closed position, and the third perimeter edge 405 of the second portion. Thus, the zipper 407 may run up one side edge 116 of the rear panel 202, along the top edge 120 of the adjacent side panel 104, along the edge of the first portion 400*a* that is adjacent to the top edge 126 of the front panel 106, along the top edge 120 of the next side panel 104, and back down the second side edge 116 of the rear panel 102. As a result, the zipper 407 may function both to secure the lid 406 in a closed position and to secure the second perimeter edge 404 and third perimeter edge 405 of the second portion 400*b* to the second perimeter edge 402 of the first portion 400*a*. In some embodiments, the zipper 407 adds additional strength to the suitcase 100 when the zipper 407 is closed. In some embodiments, the zipper 407 has two sliders 408*a-b*; as a result, the lid 406 may be disengaged from the opening of the suitcase 100 and opened, while the portions of the zipper 407 holding together the second 404 and third 405 perimeter edges of the second portion 400*b* to the second perimeter edge 402 of the first portion 400*a* remain fastened. The zipper 407 may be any form of slide fastener. In other embodiments, at least one alternative fastener is used to hold the second 404 and third 405 perimeter edges of the second portion 400*b* to the second perimeter edge 402 of the first portion. The at least one alternative fastener may be any set of fasteners that fastens the second 404 and third 405 perimeter edges of the second portion 400*b* to the second perimeter edge 402 of the first portion 400*a*, including without limitation hook-and-loop fasteners, snaps, buttons, buckles, and ties.

Figure 2E:
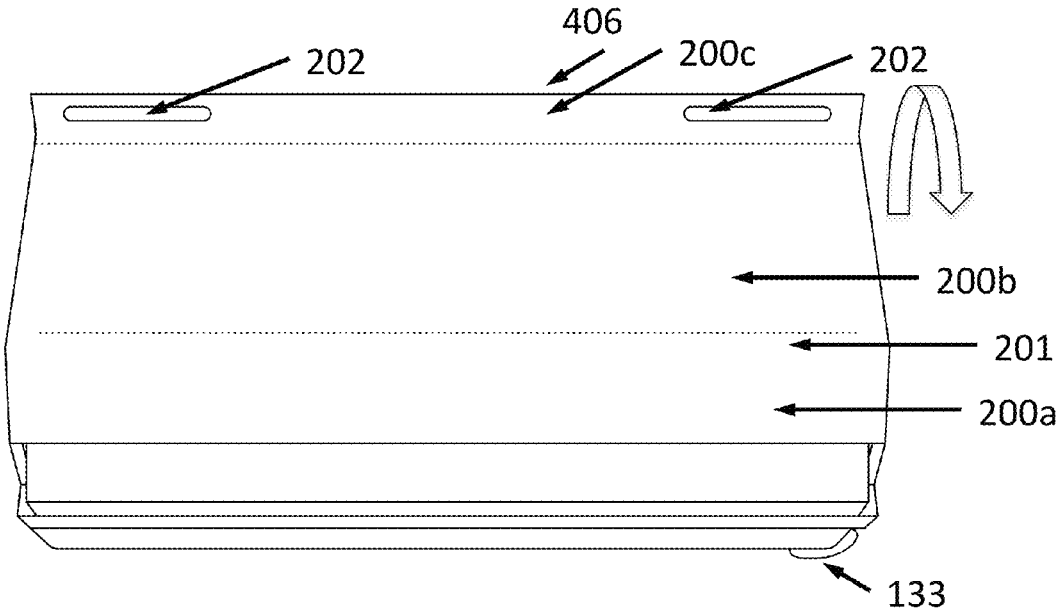
FIG. 2E is a schematic diagram illustrating step in collapsing an embodiment of a collapsible suitcase.
Figure 2F:
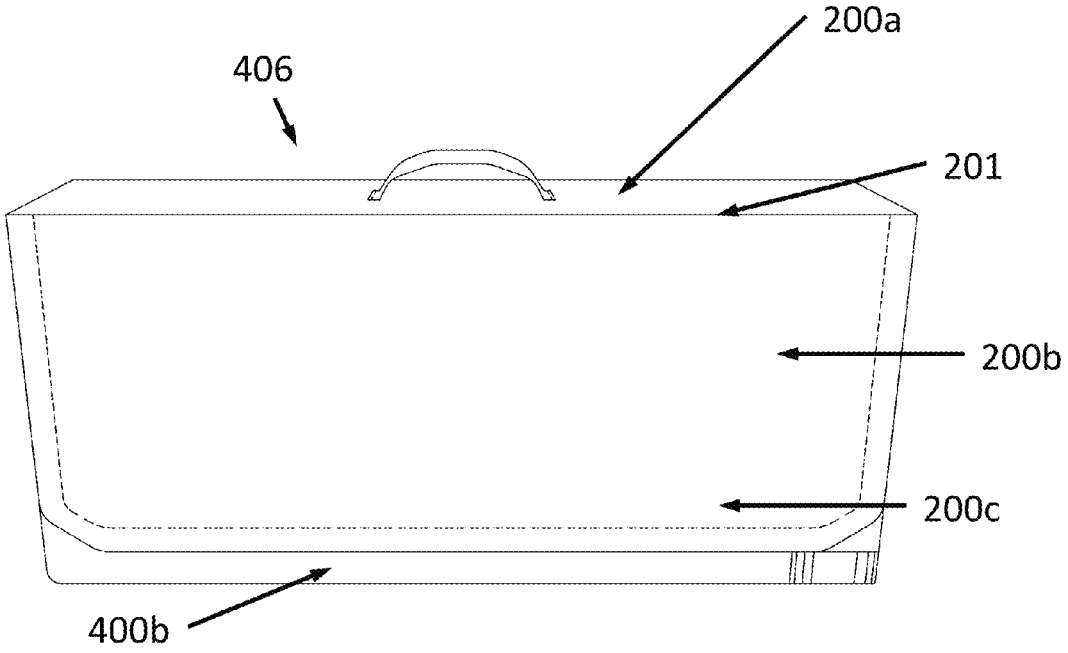
FIG. 2F is a schematic diagram illustrating step in collapsing an embodiment of a collapsible suitcase.

In some embodiments, as shown in FIG. 2E, the lid 406 includes at least one rigid panel 200*a-c*. The at least one rigid panel 200*a-c* may cause the lid 406 to present a substantially rigid surface when closed, according to the definition of rigidity described above for the bottom panel 101 in reference to FIGS. 1A-1E. In some embodiments, the at least one rigid panel further includes a first panel 200*a* and a second panel 200*b* separated by a flexible portion 201, so that the lid 406 may be wrapped around the suitcase 100 when the front panel 106, side panels 104, and rear panels 102 are in folded position, as shown in MG. 2F. In some embodiments, the lid 406 includes at least one fastener 202 that fastens the lid 406 to the second portion 400*b* at the exterior surface 109 of the bottom panel 101 of the suitcase 100 when the lid 406 is wrapped around the suitcase 100. The at least one fastener 202 may be any fastener suitable for fastening one surface to another, including but not limited to a hook-and-loop fastener, a buckle such as a slide-release buckle, tension lock, or frame buckle, a snap, a button, or a tie. In some embodiments, the at least one fastener 202 also fastens the lid 406 to the first portion 400*a* at the exterior surface 125 of the front panel 106 when the lid 406 is in the closed position and the front panel 106, is in deployed position.

In some embodiments, as is shown in FIGS. 1A-1B, each of the distance from the top edge 115 of the rear panel 102 to the to the interior surface 108 of the bottom panel 101 and the distance from the top edge 126 of the front panel 106 to the interior surface 108 of the bottom panel 101 is less than the distance from the top edge 120 of each side panel 104 to the interior surface 108 of the bottom panel 101, and the at least one rigid panel 200*a-c* of the lid 406 includes a central panel 200*b* that has a front edge 203 and a rear edge 204, occupying a position at the height of the top edges 120 of the two side panels 104 and substantially parallel to the interior surface 108 of the bottom panel 101 when the lid 406 is in its closed position, a forward panel 200*c* that slants down from the front edge 203 of the central panel 200*b* to the top edge 126 of the front panel 106 when the lid is in the closed position, and a back panel 200*a* that slants down from the back edge 204 of the central panel to the top edge 115 of the rear panel 102 when the lid is in the closed position. The suitcase may include one or more slanting top edges 136 that connect the higher top edges 120 of the side panels 104 to the lower top edges 115, 126 of the front panel 106 and the rear panel 102. The forward 200*c* and back 200*b* panels of the lid 406 may rest on the slanting top edges 136 when the lid 406 is closed. In some embodiments, the joint between the back panel 200*c* and the central panel 200*a* is in a state of elastic equilibrium when the lid 406 is in a closed position; as a result the joint is 201 is biased to allow the lid 406 to fold over the suitcase 100 with less resistance when the suitcase 100 is in its collapsed position. As an example, where the lid 406 is made up of two flexible layers with the central panel 200*b*, back panel 200*a*, and front panel 200*c* sandwiched between the two flexible layers, the flexible layer that faces the interior surface of the bottom panel when the lid 406 is in its closed position may have a slightly smaller surface area than the flexible layer that is on top of the suitcase 100 when the lid 406 is in its closed position.

Figure 4A:
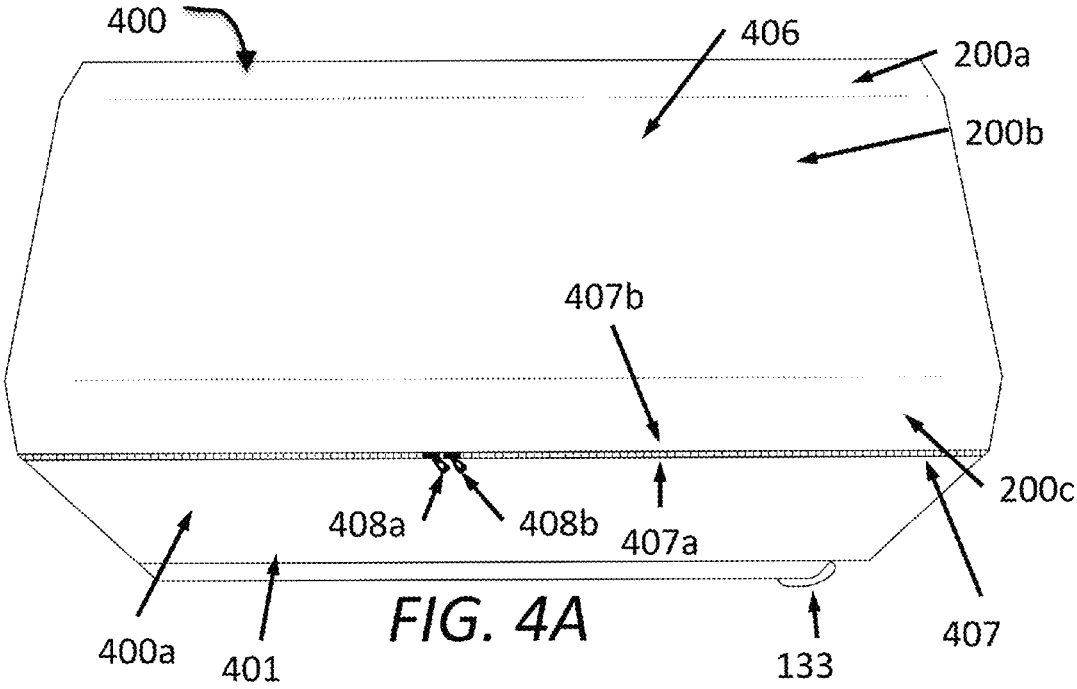
FIG. 4A is a schematic diagram illustrating an exterior covering of an embodiment of a collapsible suitcase.
Figure 4B:
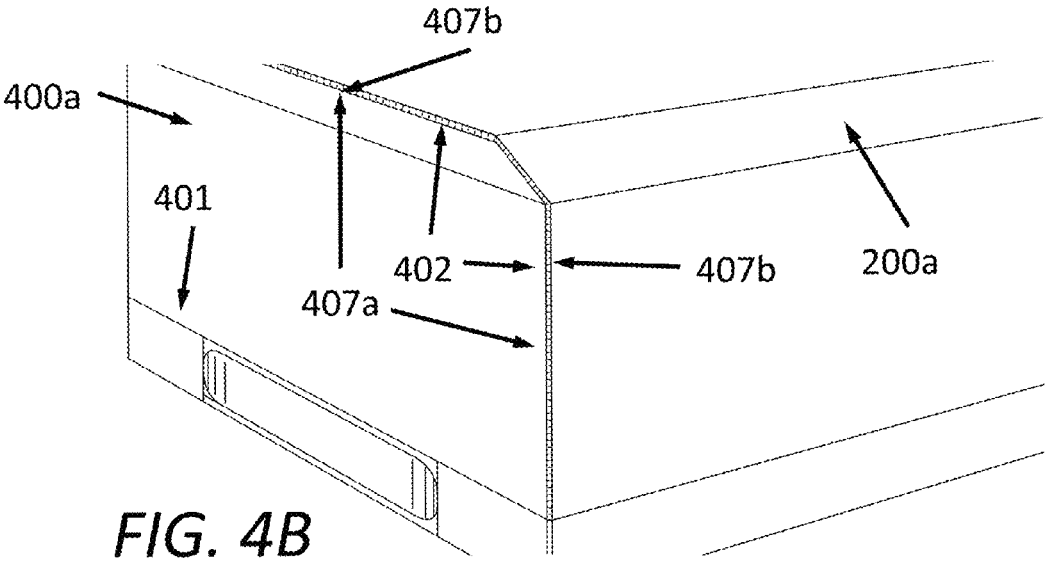
FIG. 4B is a schematic diagram illustrating an exterior covering of an embodiment of a collapsible suitcase.
Figure 4C:
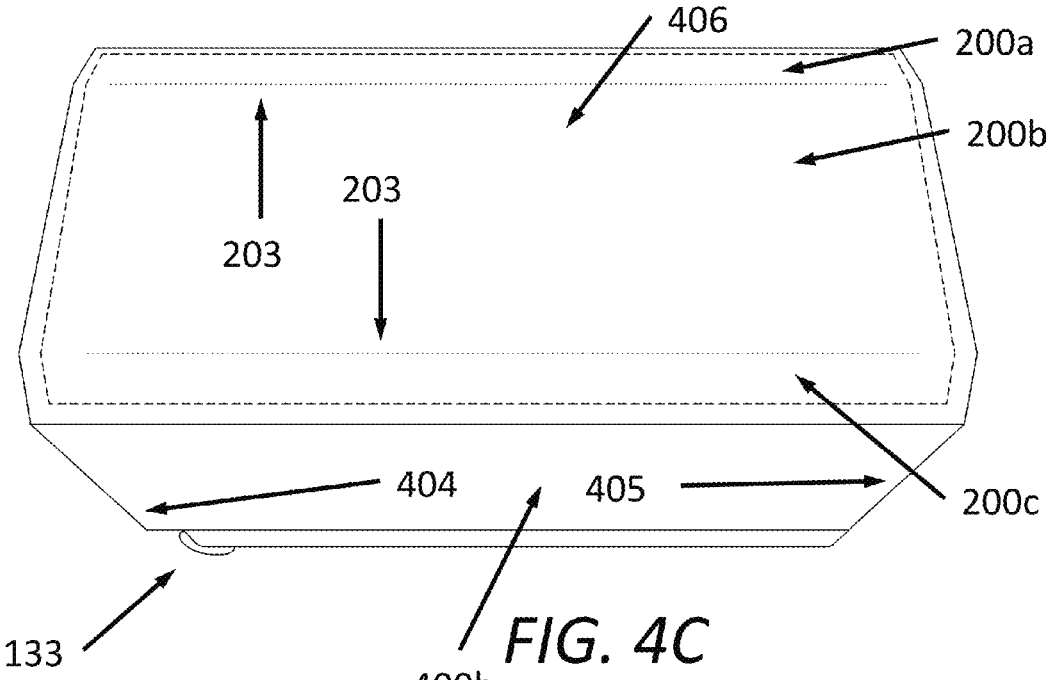
FIG. 4C is a schematic diagram illustrating an exterior covering of an embodiment of a collapsible suitcase.
Figure 4D:
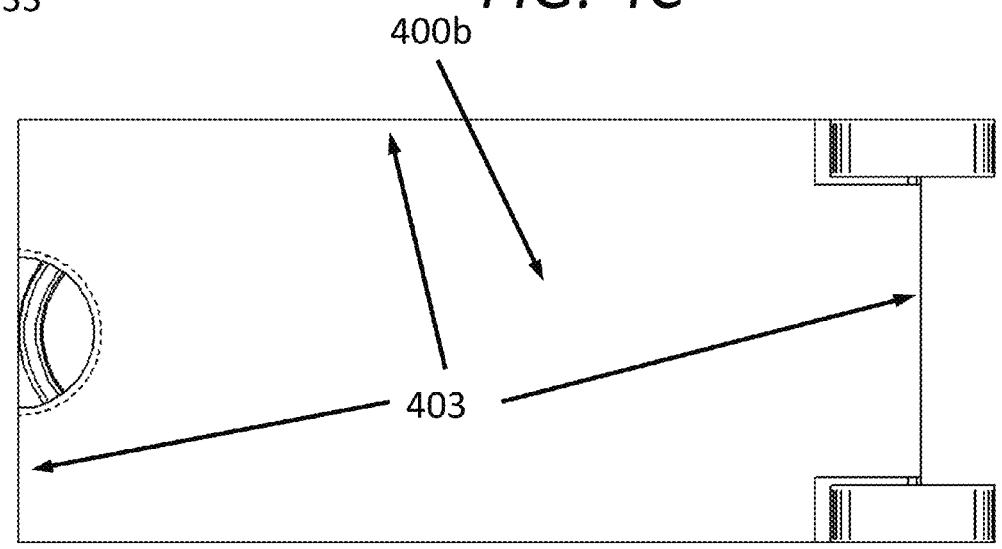
FIG. 4D is a schematic diagram illustrating an exterior covering of an embodiment of a collapsible suitcase.
Figure 4E:
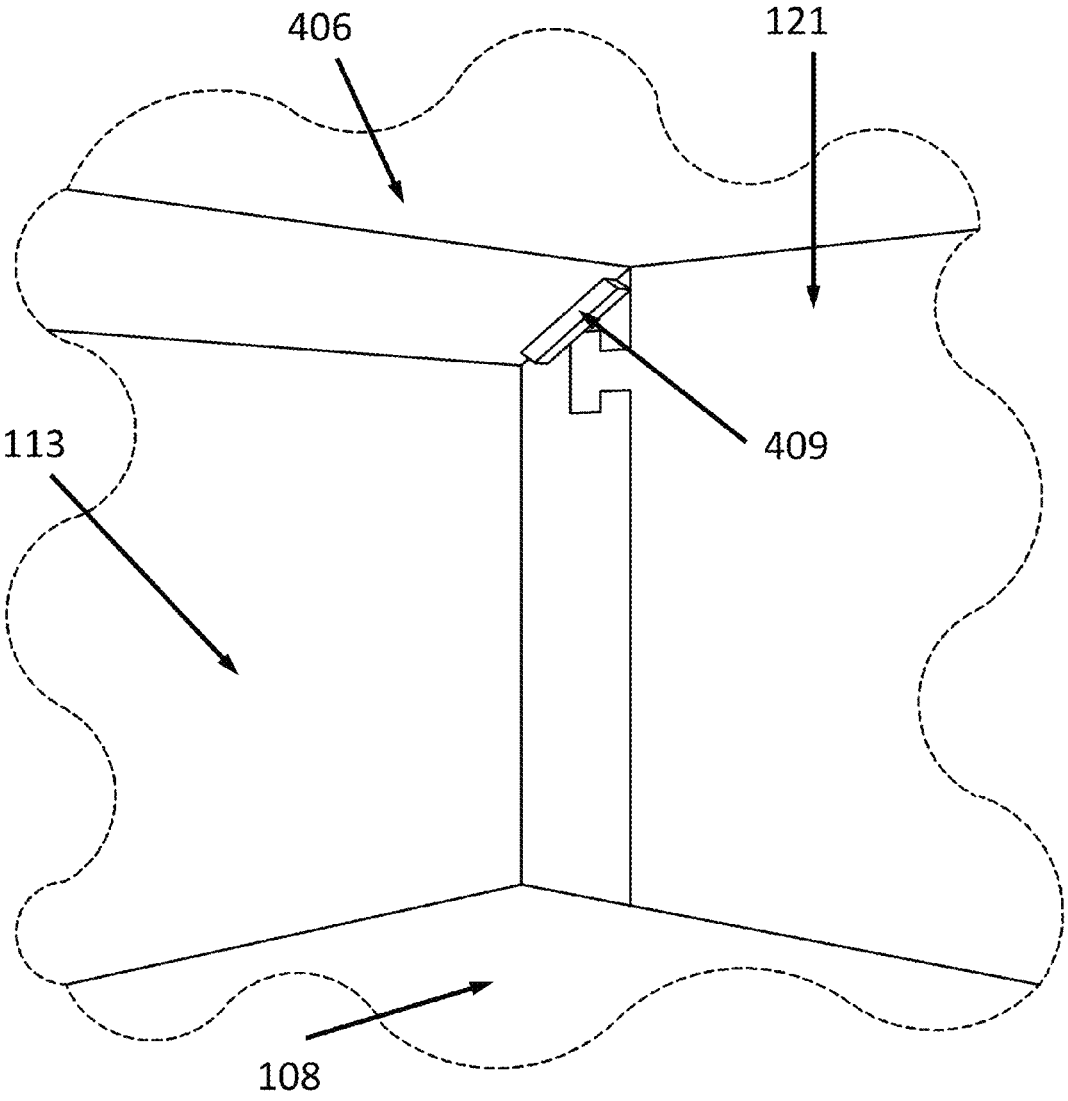
FIG. 4E is a schematic diagram illustrating a detail of a lid of an embodiment of a collapsible suitcase.

In some embodiments, as shown in FIGS. 4E and 1B, the lid 406 includes at least one projection 409 that rests against at least one of the interior surface 113 of the rear panel 102, the interior surface 118 of at least one side panel 104, or the interior surface 124 of the front panel 106 when the lid 406 is in the closed position. In some embodiments, the at least one projection 409 is a lip or ledge extending downward from the underside of the lid 406. The lip or ledge may be parallel to the edge of the lid 406. In some embodiments, the lip or ledge extends for the length of each of the interior surface 113 of the rear panel 102, the interior surface 118 of each of the side panels 104, and the interior surface 124 of the front panel 106. In other embodiments, the lip or ledge extends for the length of each of the interior surface 118 of each of the side panels 104, and the interior surface 124 of the front panel 106. In additional embodiments, the lip or ledge extends for the length of the interior surface 124 of the front panel 106. In additional embodiments, the lip or ledge extends for the length of the interior surface 118 of at least one of the side panels 104. In other embodiments, the lip or ledge extends for the length of the interior surface 113 of the rear panel 102. The lip or ledge may cover only part of the length of the interior surface of one or more panels; as a non-limiting example, the at least one projection 409 may include one lip or ledge that rests against a part of the interior surface 118 of one side panel 104 and a second lip or ledge that rests against a part of the interior surface 118 of the other side panel. In some embodiments, the at least one projection 409 adds strength and stability to the suitcase 100 when the lid 406 is closed, by bracing against the interior surface of one or more panels. The at least one projection 406 may have any shape that accomplishes that purpose, including one or more dowels, wedges, or tabs.

Figure 5A:
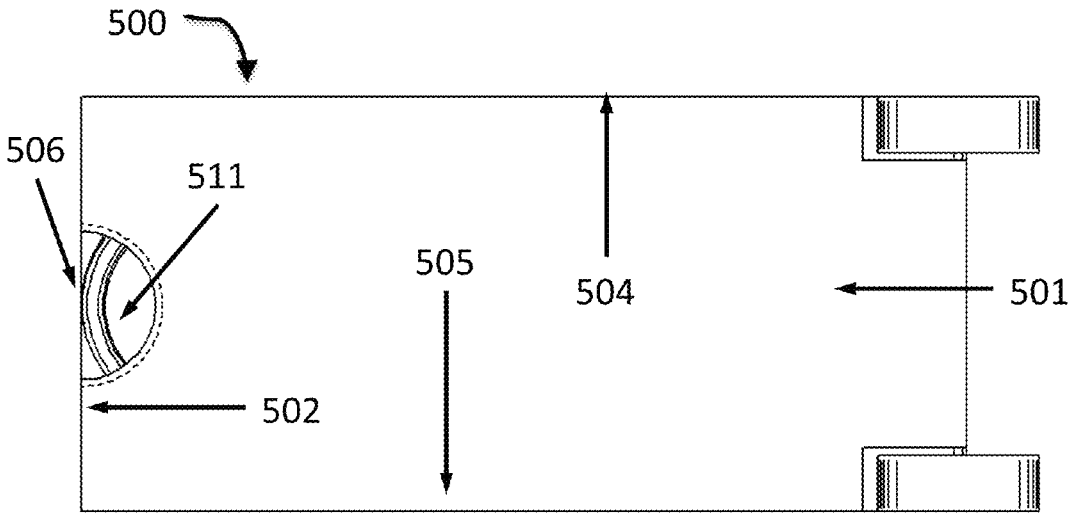
FIG. 5A is a schematic diagram illustrating one embodiment of an extensible handle system usable with a suitcase.
Figure 5B:
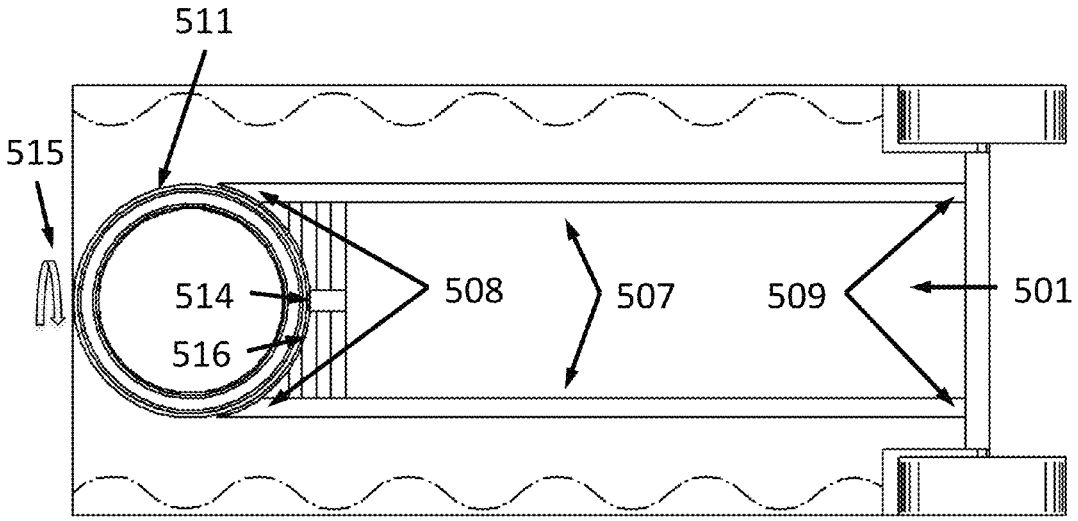
FIG. 5B is a schematic diagram illustrating one embodiment of an extensible handle system usable with a suitcase.
Figure 5C:
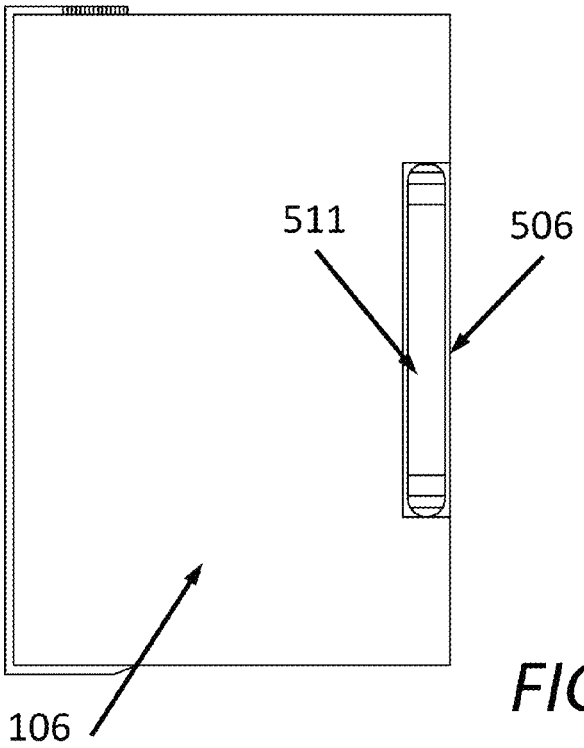
FIG. 5C is a schematic diagram illustrating one embodiment of an extensible handle system usable with a suitcase.
Figure 5D:
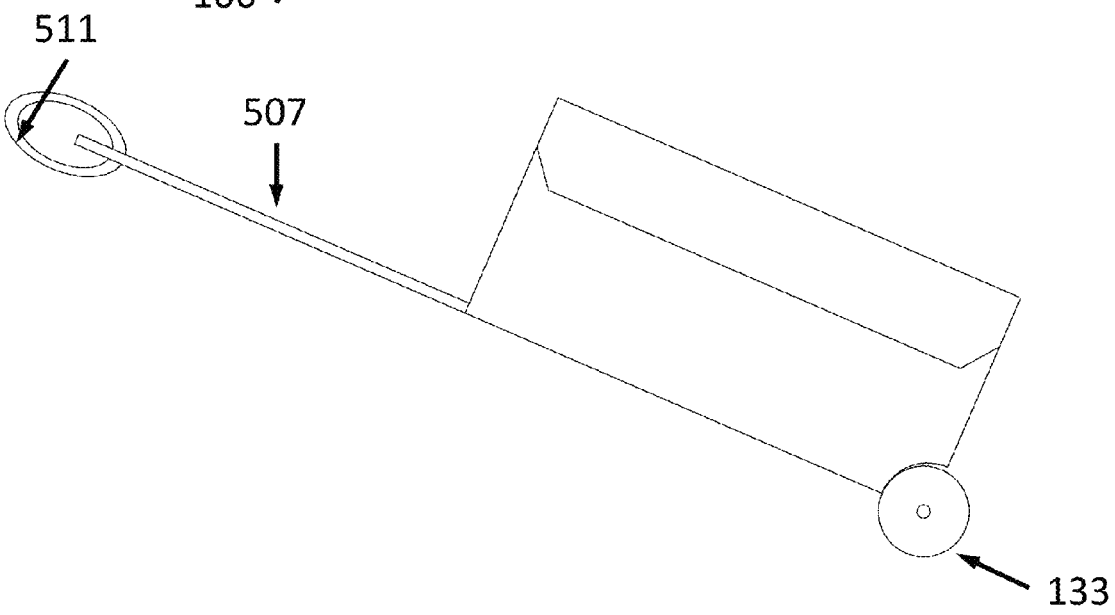
FIG. 5D is a schematic diagram illustrating one embodiment of an extensible handle system usable with a suitcase.
Figure 5E:
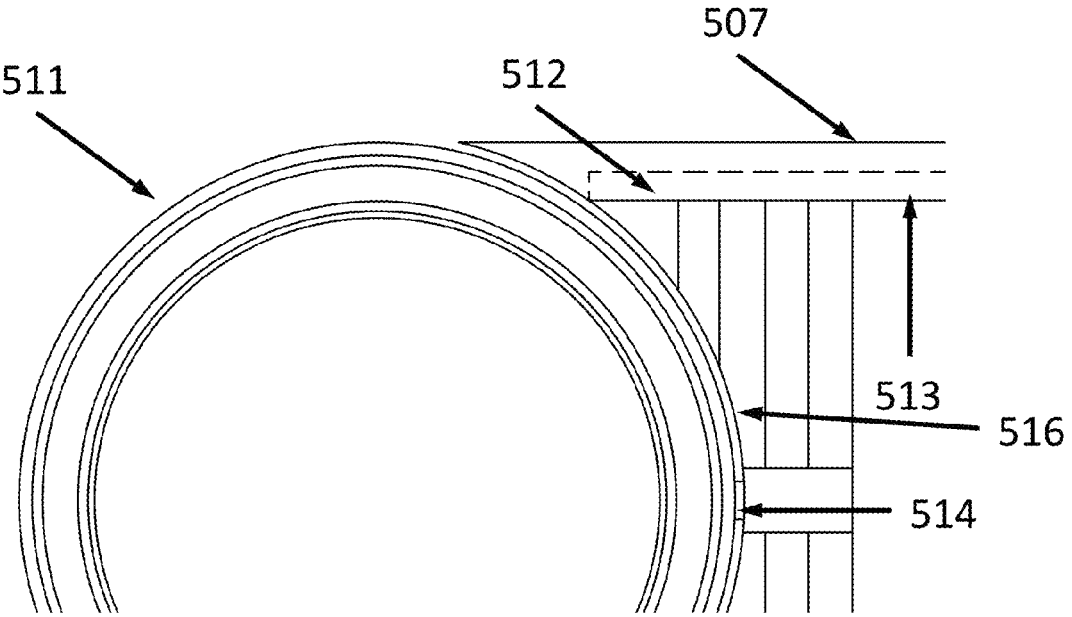
FIG. 5E is a schematic diagram illustrating one embodiment of an extensible handle system usable with a suitcase.
Figure 5F:
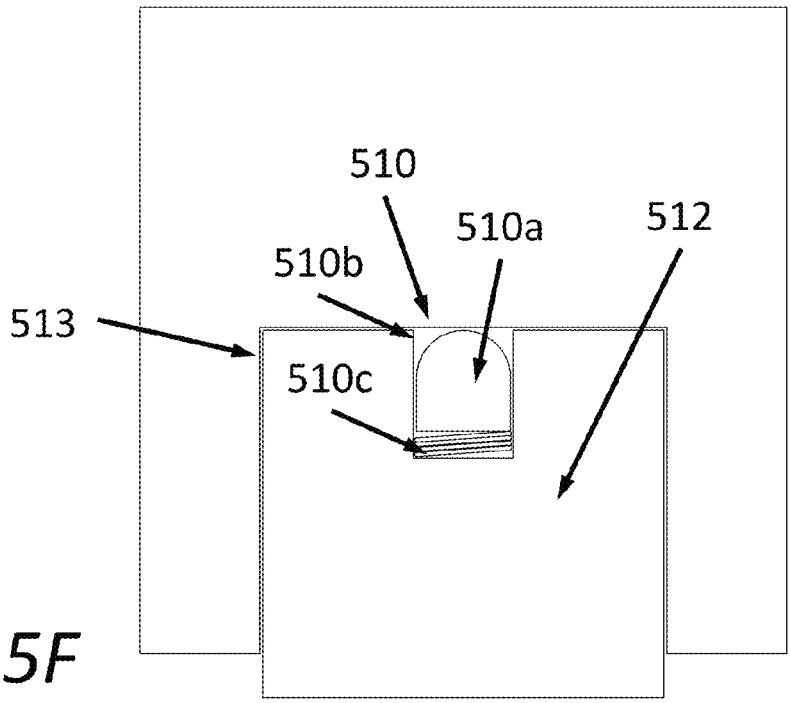
FIG. 5F is a schematic diagram illustrating one embodiment of an extensible handle system usable with a suitcase.
Figure 5G:
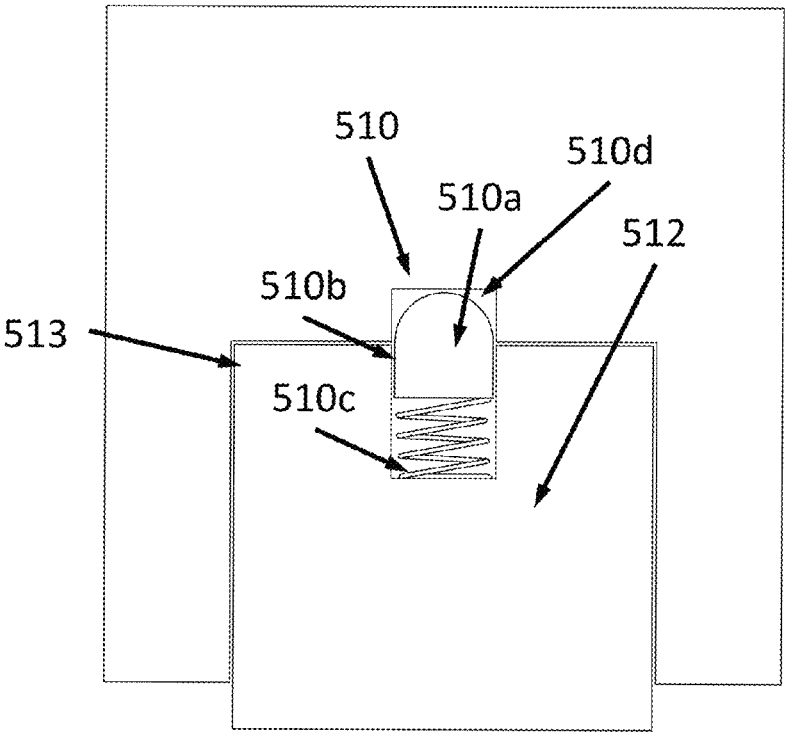
FIG. 5G is a schematic diagram illustrating one embodiment of an extensible handle system usable with a suitcase.
Figure 5H:
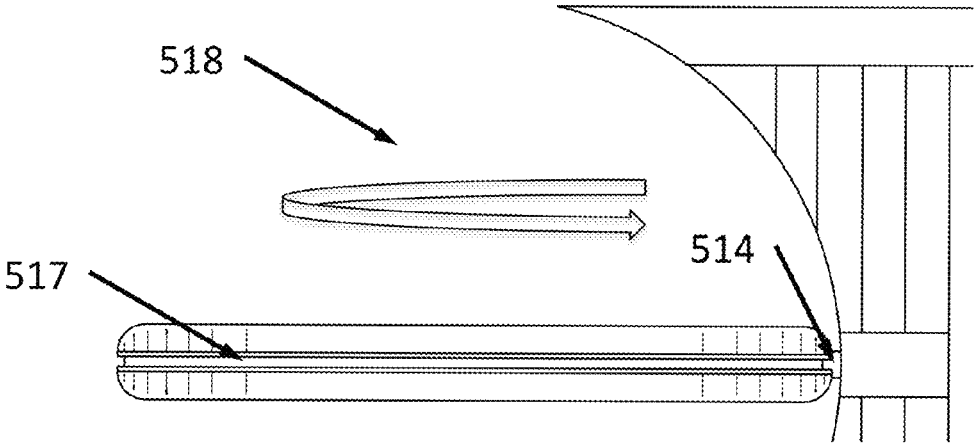
FIG. 5H is a schematic diagram illustrating one embodiment of an extensible handle system usable with a suitcase.
Figure 6A:
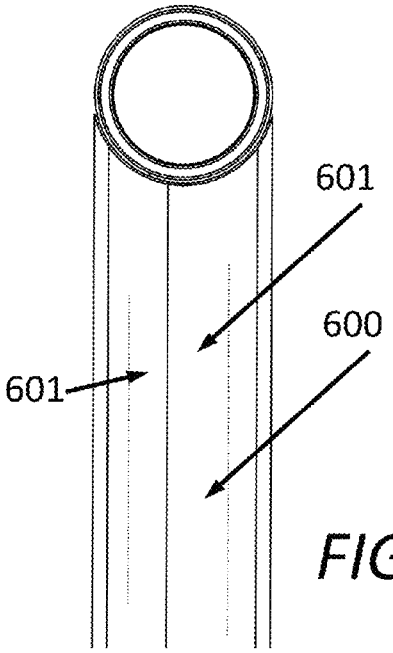
FIG. 6A is a schematic diagram illustrating one embodiment of a pocket and fold-out tray in an extensible handle.
Figure 6B:
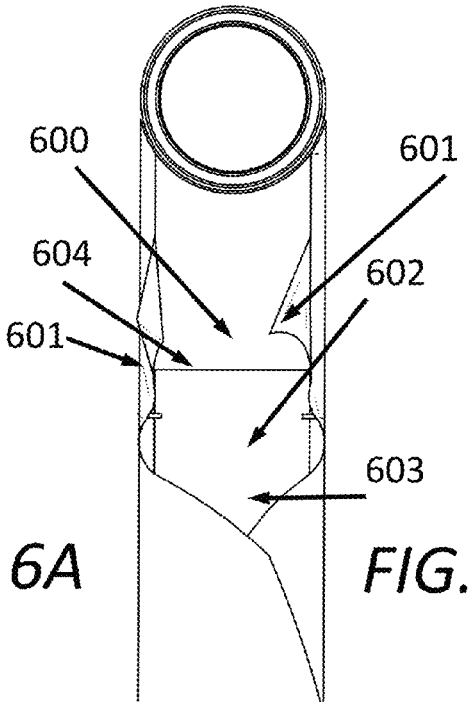
FIG. 6B is a schematic diagram illustrating one embodiment of a pocket and fold-out tray in an extensible handle.
Figure 6C:
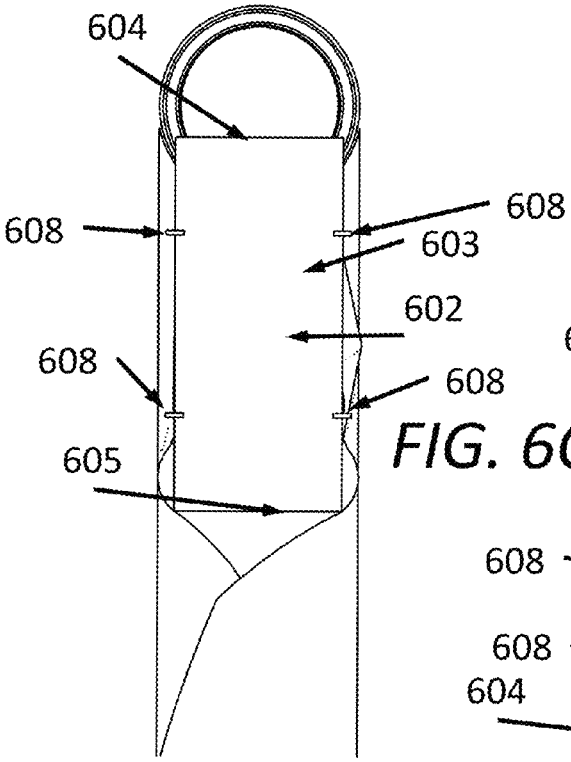
FIG. 6C is a schematic diagram illustrating one embodiment of a pocket and fold-out tray in an extensible handle.
Figure 6D:
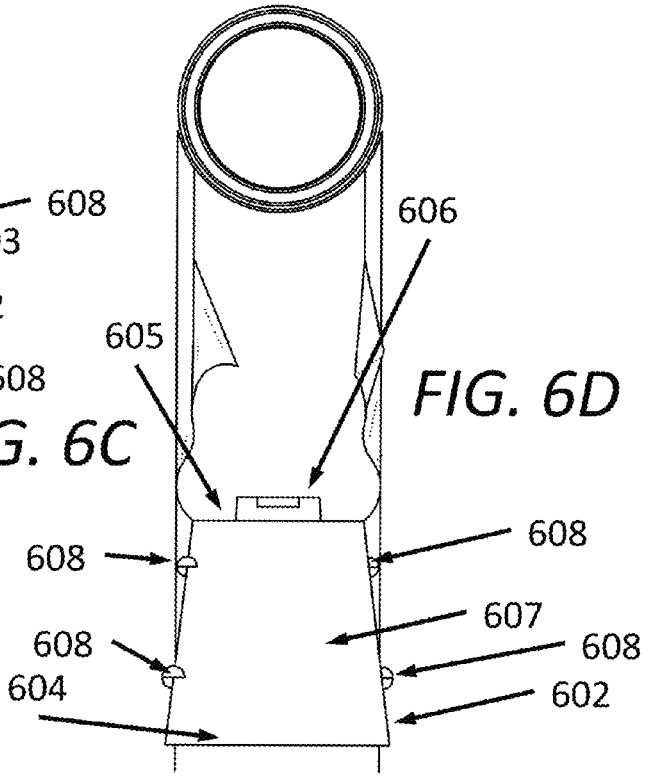
FIG. 6D is a schematic diagram illustrating one embodiment of a pocket and fold-out tray in an extensible handle.
Figure 6E:
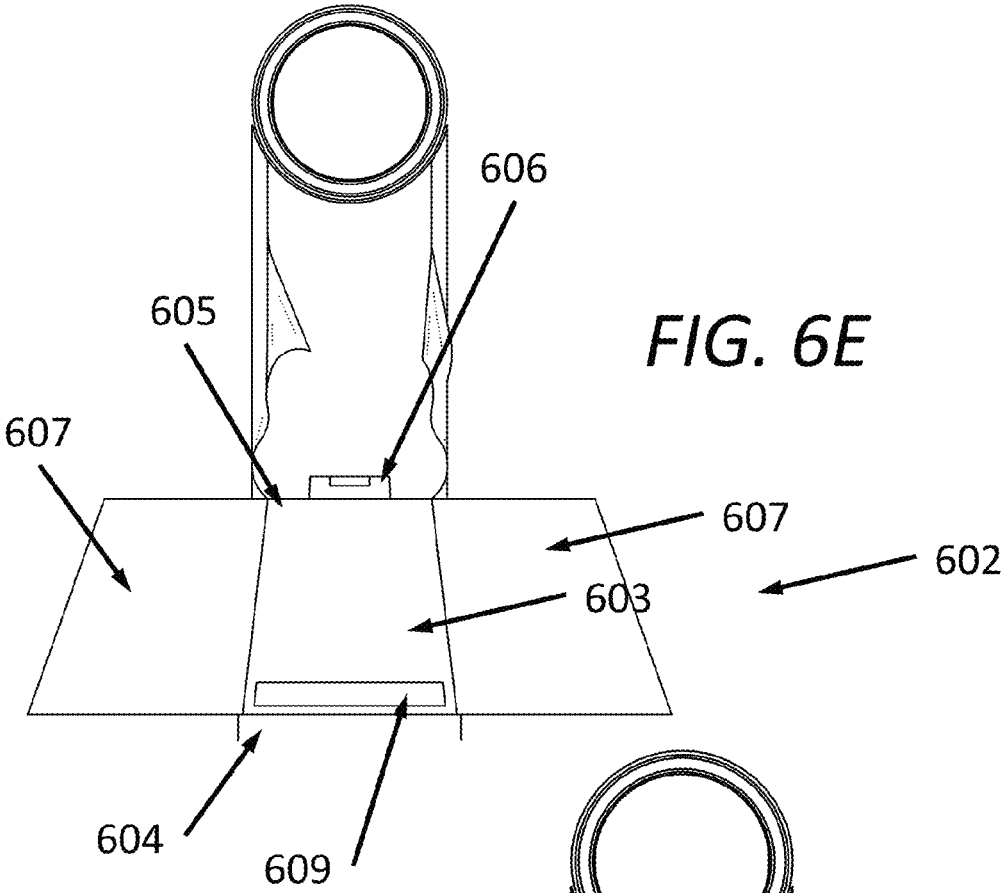
FIG. 6E is a schematic diagram illustrating one embodiment of a pocket and fold-out tray in an extensible handle.
Figure 6F:
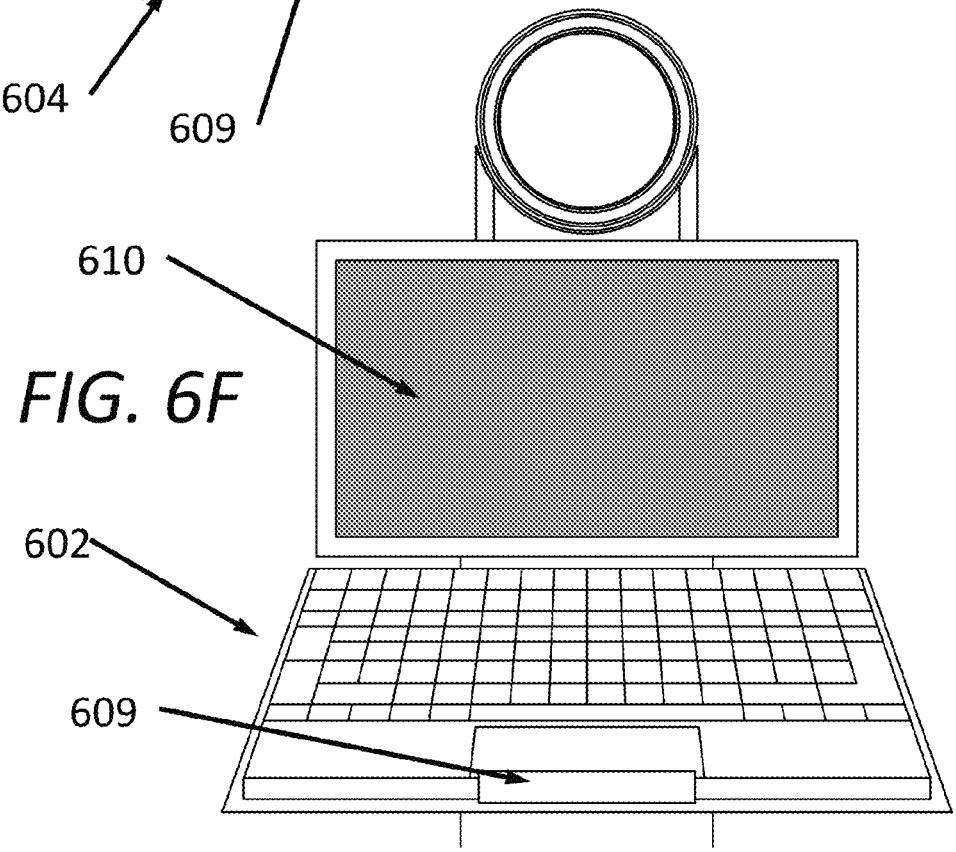
FIG. 6F is a schematic diagram illustrating one embodiment of a pocket and fold-out tray in an extensible handle.

In some embodiments, as shown in FIGS. 5A-5H, the suitcase 100 includes an extensible handle system 500. In some embodiments, the extensible handle system 500 includes a chamber 501 in the bottom panel 101. The chamber 501 may have a first end 502. The first end 502 may be at any of the side, front, or rear edges of the back panel. The chamber 501 may have a second end 503. The second end 503 may be opposite the first end 502; for instance, if the first end 502 is located at one side edge of the bottom panel 101, the second end 503 may be located at the other side edge of the bottom panel 101. The chamber 501 may include a front side 504; the front side may be parallel to an edge of the bottom panel 101, such as the front edge of the bottom panel 101. The chamber may have a back side 505 parallel to front side. The chamber 501 may have an opening 506 at the first end 502. The chamber 501 may be closed at the front side 504, back side 505, and second end 503. In some embodiments, the handle system 500 includes two handle rods 507 inserted within in the chamber 501 along the front side 504 and the back side 505 of the chamber 501. The two handle rods 507 may be free to slide out of the opening 506 into an extended position, as shown in FIG. 5D. Each handle rod 507 may have a first end 508 that extends out of the chamber 501 when the two handle rods 507 are in the extended position and a second end 509 that remains within the chamber 501 when the two handle rods 507 are in the extended position. An engagement latch 510 may fix one or both of the two handle rods 507 relative to the chamber 501 when the two handle rods 507 are in the extended position. The engagement latch 510 may include a pin 510*a* in a chamber 501*b* in the handle 507, or in a surface past which the handle 507 slides, which is urged out of its chamber 510*b* by a spring 510*c* or similar biasing means, so that when a corresponding chamber 510*d* moves opposite the chamber, the pin 510*a* will enter the corresponding chamber 510*d*. The pin 510*a* may be rounded at the end that enters the corresponding chamber 510*d*, so that a user can push the pin 510*a* back into its chamber 510*b* against the bias of the biasing means 510*c* using the corresponding chamber 510*d*, for instance by pushing the handle rod 507 back into the chamber 501. The system 500 may include several corresponding chambers 510*d*, or alternatively, several pins 510*a* at various positions along the handle rod 507 or along a surface past which the handle rod 507 slides, so that the handle rod 507 can be secured at various degrees of egress from the chamber 501. The handle system 500 may include a handle 511 connected to the first end of each handle rod 507.

In some embodiments, the extensible handle system 500 also includes two interior rods 512 inserted in the chamber 501 along the front 504 and back 505 sizes of the chamber 501. In some embodiments, each handle rod 507 has a slot 513 that slidably admits one of the two interior rods 512. The handle rods 507 may be restricted by the interior rods 512 so that they can only travel linearly by sliding along the rods 512. In some embodiments, the engagement latches 510 fix the handle rods 507 to the interior rods 512.

In some embodiments, the handle 511 is connected to the two handle rods 507 by a swivel 514 that allows the handle 511 to rotate freely about a first axis; for instance, the swivel 514 may allow the handle 511 to rotate about an axis parallel to the two handle rods 507, in the direction indicated by the arrow 515 in FIG. 5B. In some embodiments, the swivel 514 is attached to a bar 516 joining the two handle rods 507; the swivel 514 may be fixed to a point on that bar 516 that is equidistant from both handle rods 507. The handle 511 may be substantially toroidal; in some embodiments, the bar 516 is in the form of an arc, allowing it to conform to the shape of the toroidal handle 511. In some embodiments in which the handle 511 is substantially toroidal, the handle 511 contains a track 517 describing a substantial circle in handle, and the swivel 514 is slidably attached to the track 517, permitting the handle to be rotated about a second axis, such as an axis orthogonal to the annular cross-section of the handle, about which the handle rotates in the direction indicated by the directional arrow 518 presented in FIG. 511. In some embodiments, having one or two axes of rotation about which the handle 511 can freely rotate allows the user to hold the handle 511 more naturally, with an ergonomic wrist angle.

In some embodiments, as shown in FIG. 6A-6F the extensible handle system 500 includes at least one pocket 600 fixed between the two handle rods 507. The at least one pocket 600 may be capable of sliding into and out of the chamber 510 with the two handle rods 507; for instance, the at least one pocket may be confined to the space between the two handle rods 507 when it is closed. The at least one pocket may have one or more flaps 601 that may be closed to secure the pocket or opened to access the pocket 600. The one or more flaps 601 may be secured in their closed position by a fastener (not shown), such as a hook-and-loop fastener, a zipper, a button, or a snap.

In some embodiments, the at least one pocket contains a fold-out tray 602. The fold-out tray 602, may include at least one rigid panel 603 having a distal end 604 and a proximal end 605. The fold-out tray 602 may have a hinge 606 slidably attached within the pocket 600 and attached to the proximal end 605 of the panel 603. In some embodiments, the hinge 606 is slidably mounted on a rod (not shown) within the pocket 600; for instance, a hole through a part of the hinge 606 may fit snugly but slidably on the rod. The hinge 606 may have a latch (not shown) causing the hinge 606 to adopt a fixed position on the rod; the latch may be similar to the latch 508 described above in reference to FIGS. 5A-5H. In other embodiments, the latch may be a spring-loaded bolt or pin mounted in the hinge 606 that engages a hole or slot in the rod, and which the user must push or pull out of the hole or slot to enable the hinge 606 to slide again; the hinge may have an object on its outer surface that the user may push or pull to disengage the bolt or pin. In other embodiments, the rod has a flange at its upper end that arrests the hinge's movement when it has been slid to the proper height for deploying the tray 602. In some embodiments, the hinge 606 permits the tray 602 to be rotated between a position substantially parallel to the two handle rods 507 and a position substantially perpendicular to the two handle rods 507. The hinge 606 may be constructed to have a range of motion substantially limited to 90 degrees; as a result, the tray 602 may be held in its extended, horizontal position by the lower limit of the range of motion of the hinge 606. In other embodiments, the tray 602 has a brace or reinforcing rod that further limits its downward motion and helps to support the weight of objects set on the tray.

In some embodiments, the tray 602 has one or more leaves 607 joined to the at least one panel 603 by at least one hinge 608 that permits the leaves 607 to rotate between a folded position resting on the at least one panel 603 and a deployed position adjacent and parallel to the at least one panel 603. The one or more leaves 607 may be rigid, as defined above in reference to FIGS. 1A-1E. The at least one hinge 608 may support the one or more leaves 607 in their deployed positions. In some embodiments, the tray 602 includes a lip 609 at the distal end 604 of the at least one panel 603. The lip 609 may fold against the at least one panel 603, for instance using a hinge (not shown), and may deploy to a substantially vertical position to help secure an object 610 placed on the tray 602.

In some embodiments, the suitcase 100 incorporates the handle system 500 as described above in reference to FIGS. 5A-5H, while not incorporating one or more features described above in reference to FIGS. 1A-4D. For instance, the suitcase 100 may be a non-collapsible suitcase 100 that includes the extensible handle system 500 as described above in reference to FIGS. 5A-5H. As another example, the suitcase 100 may incorporate the extensible handle system 500, and be wholly or partially collapsible or extensible using a different structure than the collapsible structure described above in reference to FIGS. 1A-4D.

Figure 7:
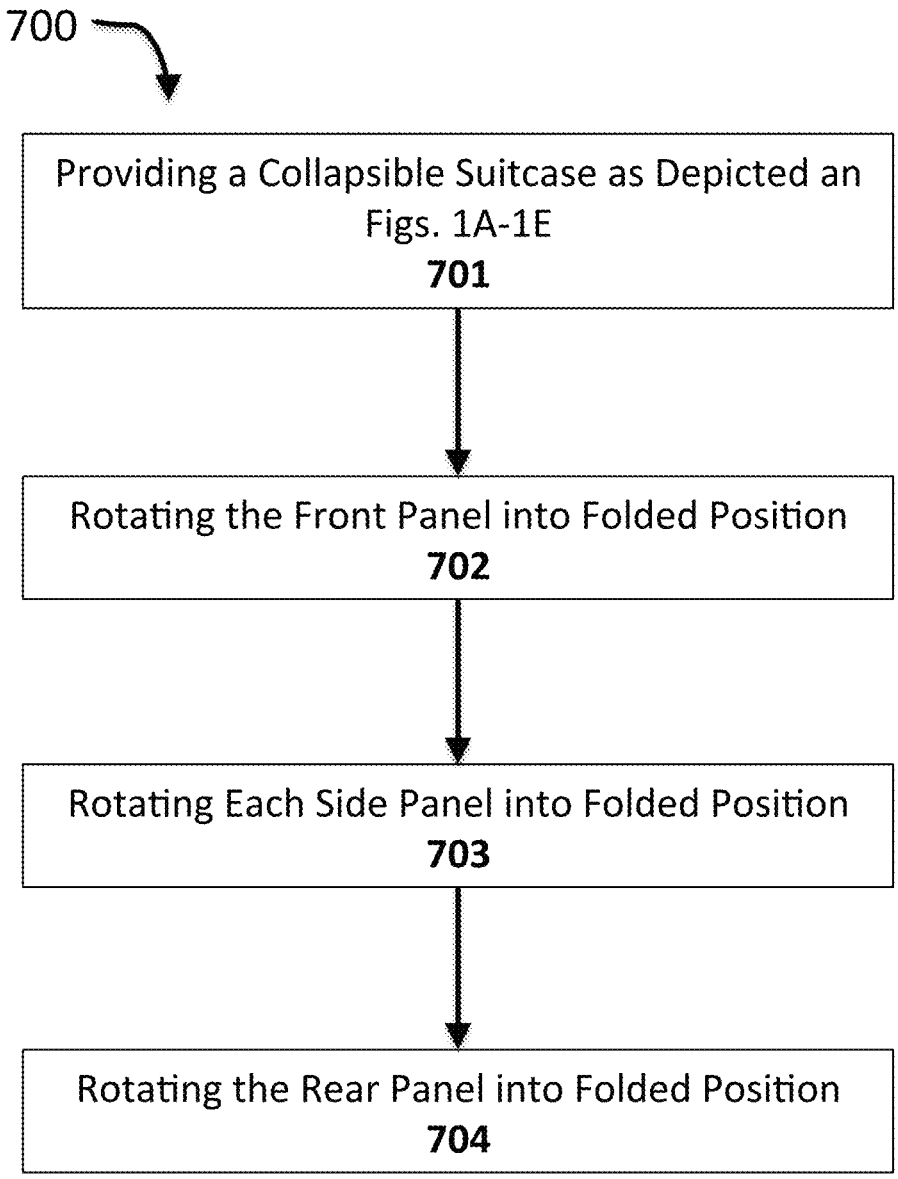
FIG. 7 is a flow diagram illustrating one embodiment of the disclosed method for collapsing a collapsible suitcase.

FIG. 7 is a flow chart illustrating one embodiment of the disclosed method 700 for collapsing a collapsible suitcase. The method 700 includes providing a collapsible suitcase as describe above in reference to FIGS. 1A-1E (701). The method 700 includes rotating the front panel into folded position (702). In some embodiments, this is implemented as described above in reference to FIG. 2A. Rotating the front panel 106 may include disengaging the latch 128 as shown in FIG. 2A. The method 700 includes rotating each side panel into folded position (703); in some embodiments this is implemented as illustrated in FIG. 2B. The method 700 may further include folding a portion of the exterior covering 400 up over the side panels, as depicted in FIG. 2B. The method 700 includes rotating the rear panel into folded position (704); in some embodiments, this is implemented as depicted in FIG. 2C. Some embodiments further include wrapping the lid 406 around the suitcase 100 after the suitcase 100 has been collapsed; in some embodiments, the lid 406 is secured to the second portion 400*b* of the exterior covering 400 using the fastener 202.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A collapsible suitcase, comprising:

a front hinge;

a rear hinge;

a first side hinge;

a second side hinge;

a bottom panel having an interior surface, an exterior surface, a rear edge, a front edge, a first side edge, and a second side edge, wherein the bottom panel is rigid, and wherein the rear edge of the bottom panel is connected to the rear hinge, the front edge of the bottom panel is connected to the front hinge, the first side edge of the bottom panel is connected to the first side hinge, and the second side edge of the bottom panel is connected to the second side hinge;

a rear panel having an interior surface, an exterior surface, a top edge, two side edges, and a bottom edge, wherein the rear panel is rigid, and wherein the bottom edge of the rear panel is connected to the rear edge of the bottom panel by the rear hinge, and wherein the rear hinge allows the rear panel to be rotated between a folded position in which the interior surface of the rear panel is substantially parallel to the interior surface of the bottom panel and a deployed position in which the interior surface of the rear panel is substantially perpendicular to the interior surface of the bottom panel;

two side panels, each side panel having an interior surface, an exterior surface, a top edge, a rear edge, a front edge, and a bottom edge, and wherein the bottom edge of a first side panel of the two side panels is connected to the first side edge of the bottom panel by the first side hinge, and wherein the bottom edge of a second side panel of the two side panels is connected to the second side edge of the bottom panel by the second side hinge, and wherein the first and second side hinges permit the first and second side panels to rotate between folded positions in which the interior surfaces of the first and second side panels are substantially parallel to the interior surface of the bottom panel and deployed positions in which the interior surfaces of the first and second side panels are substantially perpendicular to the interior surface of the bottom panel;

a front panel having an interior surface, an exterior surface, a top edge, two side edges, and a bottom edge, and wherein the bottom edge of the front panel is connected to the front edge of the bottom panel by the front hinge, and wherein the front hinge permits the front panel to rotate between a folded position in which the interior surface of the front panel is substantially parallel to the interior surface of the bottom panel and a deployed position in which the interior surface of the front panel is substantially perpendicular to the interior surface of the bottom panel;

at least one peg attached to and set perpendicularly to the interior surface of the bottom panel where the bottom edge of the rear panel, first side panel, second side panel, or front panel contacts the interior surface of the bottom panel when in the deployed position; and at least one hole in the bottom edge of the rear panel, first side panel, second side panel, or front panel, the at least one hole positioned to pass over the at least one peg when the rear panel, first side panel, second side panel, or front panel is rotated into the deployed position, wherein:

the front hinge has a first clearance to allow the interior surface of the front panel to rest on the interior surface of the bottom panel when the front panel is in the folded position, each of the first and second side hinges has a second clearance sufficiently larger than the first clearance to allow the interior surfaces of the first and second side panels, when in the folded positions, to rest on top of the exterior surface of the front panel when the front panel is in the folded position, and the rear hinge has a third clearance sufficiently larger than the second clearance to allow the interior surface of the rear panel, when in the folded position, to rest on top of the exterior surfaces of the first and second side panels when the first and second side panels are in the folded positions.

2. The collapsible suitcase according to claim 1, wherein each side edge of the rear panel further comprises at least one first engagement member, and the rear edge of the first side panel has a second engagement member configured to slidably engage the at least one first engagement member, thereby fixing the first side panel to the rear panel when the rear panel is in the deployed position and the first side panel is rotated into the deployed position.

3. The collapsible suitcase according to claim 1, wherein the front edge of the first side panel has a first engagement member, and a corresponding one of the two side edges of the front panel has a second engagement member configured to slidably engage the first engagement member, thereby fixing the front panel to the first side panel when the first side panel is in the deployed position and the front panel is rotated into the deployed position.

4. The collapsible suitcase according to claim 1, further comprising at least one latch configured to secure the front edge of the first side panel to the front panel when the first side panel is in the deployed position and the front panel is rotated into the deployed position.

5. A collapsible suitcase comprising:

a front hinge;

a rear hinge;

a first side hinge;

a second side hinge;

a bottom panel having an interior surface, an exterior surface, a rear edge, a front edge, a first side edge, and a second side edge, wherein the bottom panel is rigid, and wherein the rear edge of the bottom panel is connected to the rear hinge, the front edge of the bottom panel is connected to the front hinge, the first side edge of the bottom panel is connected to the first side hinge, and the second side edge of the bottom panel is connected to the second side hinge;

a rear panel having an interior surface, an exterior surface, a top edge, two side edges, and a bottom edge, wherein the rear panel is rigid, and wherein the bottom edge of the rear panel is connected to the rear edge of the bottom panel by the rear hinge, and wherein the rear hinge allows the rear panel to be rotated between a folded position in which the interior surface of the rear panel is substantially parallel to the interior surface of the bottom panel and a deployed position in which the interior surface of the rear panel is substantially perpendicular to the interior surface of the bottom panel;

two side panels, each side panel having an interior surface, an exterior surface, a top edge, a rear edge, a front edge, and a bottom edge, and wherein the bottom edge of a first side panel of the two side panels is connected to the first side edge of the bottom panel by the first side hinge, and wherein the bottom edge of a second side panel of the two side panels is connected to the second side edge of the bottom panel by the second side hinge, and wherein the first and second side hinges permit the first and second side panels to rotate between folded positions in which the interior surfaces of the first and second side panels are substantially parallel to the interior surface of the bottom panel and deployed positions in which the interior surfaces of the first and second side panels are substantially perpendicular to the interior surface of the bottom panel; and a front panel having an interior surface, an exterior surface, a top edge, two side edges, and a bottom edge, and wherein the bottom edge of the front panel is connected to the front edge of the bottom panel by the front hinge, and wherein the front hinge permits the front panel to rotate between a folded position in which the interior surface of the front panel is substantially parallel to the interior surface of the bottom panel and a deployed position in which the interior surface of the front panel is substantially perpendicular to the interior surface of the bottom panel; and an exterior covering, the exterior covering comprising:

a first portion fixed to the exterior surface of the first side panel and the exterior surface of the second side panel and connecting the front edge of the first side panel to the front edge of the second side panel so that the exterior surface of the front panel rests against the first portion when the front panel is in the deployed position, the first portion having a first perimeter edge against the bottom edge of the first side panel, against the bottom edge of the second side panel, and against the front edge of the bottom panel, and a second perimeter edge against the rear edge of the first side panel, against the rear edge of the second side panel, against the top edge of each side panel, and against the top edge of the front panel when the front panel is in the deployed position, and a second portion fixed to the exterior surface of the bottom panel and fixed to the exterior surface of the rear panel, and having a first perimeter edge fixed to the first perimeter edge of the first portion, a second perimeter edge against one side edge of the rear panel, and a third perimeter edge against the other side edge of the rear panel, wherein:

the front hinge has a first clearance to allow the interior surface of the front panel to rest on the interior surface of the bottom panel when the front panel is in the folded position, each of the first and second side hinges has a second clearance sufficiently larger than the first clearance to allow the interior surfaces of the first and second side panels, when in the folded positions, to rest on top of the exterior surface of the front panel when the front panel is in the folded position, and the rear hinge has a third clearance sufficiently larger than the second clearance to allow the interior surface of the rear panel, when in the folded position, to rest on top of the exterior surfaces of the first and second side panels when the first and second side panels are in the folded positions.

6. The collapsible suitcase according to claim 5, wherein the second portion further comprises a lid configured to fold to a closed position covering an opening in the collapsible suitcase bordered by the top edge of the rear panel, the top edge of the first side panel, the top edge of the second side panel, and the top edge of the front panel when the rear panel, the first and second side panels, and the front panel are in the deployed position.

7. The collapsible suitcase according to claim 6, wherein the lid further comprises at least one projection that rests against at least one of the interior surface of the rear panel, the interior surface of the first side panel, the interior surface of the second side panel, or the interior surface of the front panel when the lid is in the closed position.

8. The collapsible suitcase according to claim 6, further comprising a zipper having a first half that covers the second perimeter edge of the first portion and a second half covering the second perimeter edge of the second portion, a portion of the lid that contacts the second perimeter edge of the first portion when the lid is in the closed position, and the third perimeter edge of the second portion.

9. The collapsible suitcase according to claim 6, wherein the lid further comprises at least one rigid panel.

10. The collapsible suitcase according to claim 6, wherein the lid is flexible and configured to wrap around the suitcase when the front panel, two side panels, and rear panels are in the folded positions.

11. The collapsible suitcase according to claim 10, wherein the lid further comprises a first rigid panel and a second rigid panel separated by a flexible portion.

12. The collapsible suitcase according to claim 10, wherein:

each of (i) a distance from the top edge of the rear panel to the to the interior surface of the bottom panel and (ii) a distance from the top edge of the front panel to the interior surface of the bottom panel is less than a distance from the top edge of each of the two side panels to the interior surface of the bottom panel, and the lid further comprises:

a central panel that has a front edge and a rear edge, occupying a position at a height of the top edges of the two side panels and substantially parallel to the interior surface of the bottom panel when the lid is in the closed position, a forward panel flexibly joined to the front edge of the central panel, the forward panel slanting down from the front edge of the central panel to the top edge of the front panel when the lid is in the closed position, and a back panel flexibly joined to the rear edge of the central panel, the back panel slanting down from the rear edge of the central panel to the top edge of the rear panel when the lid is in the closed position.

13. The collapsible suitcase according to claim 10, further comprising at least one fastener configured to fasten the lid to the second portion of the exterior covering at the exterior surface of the bottom panel when the lid is wrapped around the suitcase.

14. The collapsible suitcase according to claim 5, further comprising an extensible handle system, the extensible handle system comprising:

a chamber in the bottom panel, the chamber having a first end, a second end, a front side, and a back side parallel to the front side, the chamber having an opening at the first end;

two handle rods inserted within in the chamber along the front side and the back side of the chamber, the two handle rods free to slide out of the opening into an extended position, each handle rod having a first end that extends out of the chamber when the two handle rods are in the extended position and a second end that remains within the chamber when the two handle rods are in the extended position;

at least one engagement latch configured to fix a position of the two handle rods relative to the chamber when the two handle rods are in the extended position; and a handle coupled to the first end of each handle rod.

15. The collapsible suitcase according to claim 14, wherein the extensible handle system further comprises two interior rods inserted in the chamber along the front and back sides of the chamber, wherein each handle rod contains a slot configured to slidably admit one of the two interior rods, and wherein the at least one engagement latch fixes the two handle rods to the two interior rods.

16. The collapsible suitcase according to claim 15, wherein the handle is connected to the two handle rods by a swivel that allows the handle to rotate freely about a first axis.

17. The collapsible suitcase according to claim 16, wherein the handle is substantially toroidal, the handle contains a track describing a substantial circle on the handle, and the swivel is slidably attached to the track, permitting the handle to be rotated about a second axis.

18. A method for collapsing a collapsible suitcase, the method comprising:

providing the collapsible suitcase according to claim 5;

rotating the front panel into the folded position;

rotating the two side panels into the folded positions; and rotating the rear panel into the folded position.

* * * * *